US012509315B2

(12) United States Patent
Aoki et al.

(10) Patent No.: US 12,509,315 B2
(45) Date of Patent: Dec. 30, 2025

(54) SHEET CONVEYANCE APPARATUS AND IMAGE FORMING APPARATUS

(71) Applicant: CANON KABUSHIKI KAISHA, Tokyo (JP)

(72) Inventors: Kenji Aoki, Tokyo (JP); Kengo Sato, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 190 days.

(21) Appl. No.: 18/338,586

(22) Filed: Jun. 21, 2023

(65) Prior Publication Data

US 2024/0002182 A1 Jan. 4, 2024

(30) Foreign Application Priority Data

Jul. 4, 2022 (JP) ..... 2022-107601

(51) Int. Cl.
*B65H 5/06* (2006.01)
*B65H 9/00* (2006.01)
*B65H 9/16* (2006.01)

(52) U.S. Cl.
CPC ..... *B65H 9/002* (2013.01); *B65H 5/062* (2013.01); *B65H 9/166* (2013.01)

(58) Field of Classification Search
CPC ..... B65H 2404/144; B65H 2404/1441; B65H 2404/1442
See application file for complete search history.

(56) References Cited

U.S. PATENT DOCUMENTS 6,817,609 B2 * 11/2004 Halvonik ..... B65H 9/20 271/259
7,540,496 B2 * 6/2009 Fukushima ..... B65H 9/002 271/253
7,658,379 B2 * 2/2010 Yasumoto ..... B65H 9/16 271/251
9,676,577 B2 * 6/2017 Schoenmakers ..... B65H 5/068
9,938,101 B2 * 4/2018 Watanabe ..... B65H 5/062
10,618,760 B2 * 4/2020 Ishioka ..... B65H 9/166
11,643,292 B2 * 5/2023 Nakagawa ..... G03G 15/6564 270/1.01
11,952,239 B2 * 4/2024 Chiba ..... B65H 7/10
(Continued)

FOREIGN PATENT DOCUMENTS

JP 2022013356 A 1/2022

*Primary Examiner* — Howard J Sanders
(74) *Attorney, Agent, or Firm* — ROSSI, KIMMS & McDOWELL LLP

(57) ABSTRACT

A sheet conveyance apparatus includes a first roller pair, a second roller pair, an abutment portion, an oblique feeding portion, a detection portion, a moving portion a contact/separation portion, and a control portion. If a first sheet whose length is a first length is conveyed, the control portion causes the moving portion to move the first roller pair, and then causes the first sheet to be conveyed from the first roller pair to the oblique feeding portion through the second roller pair that is in the separation state, and if a second sheet whose length is a second length shorter than the first length is conveyed, the control portion causes the moving portion to move the first roller pair, and then causes the second sheet to be conveyed from the first roller pair to the oblique feeding portion via the second roller pair that is in the contact state.

20 Claims, 14 Drawing Sheets

(56) References Cited

U.S. PATENT DOCUMENTS

| | | | | |
|---|---|---|---|---|
| 12,264,037 | B2 * | 4/2025 | Ito | B65H 7/06 |
| 2022/0002104 | A1 | 1/2022 | Matsumoto | |
| 2024/0034586 | A1 * | 2/2024 | Ito | B65H 7/06 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus that conveys sheets, and an image forming apparatus that forms images on sheets.

Description of the Related Art

A so-called side-registration sheet conveyance apparatus is known. The side-registration sheet conveyance apparatus corrects the skew of a sheet by causing oblique feeding rollers to obliquely convey the sheet, and by causing a side edge of the sheet to abut against a reference member. Japanese Patent Application Publication No. 2022-013356 describes a configuration for correcting a sheet position in a sheet width direction. In this configuration, a conveyance roller pair (i.e., a slide roller) disposed upstream of oblique feeding rollers in a sheet conveyance direction slides, so that the sheet position is corrected in the sheet width direction, depending on a detection result by a sheet-position detection sensor. In Japanese Patent Application Publication No. 2022-013356, since the sheet position is corrected before the oblique feeding is started, the distance by which the sheet is conveyed while being caused to abut against the reference member becomes almost constant. As a result, variations in the timing of conveyance performed downstream of the oblique feeding rollers are reduced, so that the productivity can be increased.

In Japanese Patent Application Publication No. 2022-013356, when the sheet position is corrected by the slide roller, the slide roller is moved in a state where the sheet is not retained by other conveyance roller pairs, a conveyance guide, and the like, which are disposed upstream of the slide roller, for preventing any damage of the sheet and failure in the correction. Thus, if a sheet that is relatively long in the sheet conveyance direction is conveyed, the timing at which the sheet is released from the upstream conveyance roller pairs and the like is delayed, compared with the timing at which a sheet that is relatively short in the sheet conveyance direction is released. For this reason, it is desired to secure a sufficient moving time of the slide roller. However, if the distance from the slide roller to the oblique feeding rollers is increased for securing the sufficient moving time of the slide roller, it becomes difficult to convey the short sheet.

SUMMARY OF THE INVENTION

The present invention provides a sheet conveyance apparatus and an image forming apparatus in which variety of sizes of sheets can be used and in which variations in conveyance timing can be reduced.

According to an aspect of the invention, sheet conveyance apparatus includes a first roller pair configured to convey a sheet, a second roller pair disposed downstream of the first roller pair in a sheet conveyance direction and configured to convey the sheet, an abutment portion against which an edge portion of the sheet in a sheet width direction orthogonal to the sheet conveyance direction is abutted, an oblique feeding portion disposed downstream of the second roller pair in the sheet conveyance direction and configured to move the sheet toward the abutment portion in the sheet width direction while moving the sheet downstream in the sheet conveyance direction and convey the sheet while causing the edge portion of the sheet to abut against the abutment portion, a detection portion configured to detect a position of the sheet in the sheet width direction, a moving portion configured to move the first roller pair in the sheet width direction, a contact/separation portion configured to switch a state of the second roller pair between a contact state and a separation state, the contact state being a state where rollers of the second roller pair are in contact with each other, the separation state being a state where the rollers are separated from each other, and a control portion configured to control the moving portion and the contact/separation portion, wherein the control portion is configured such that if a first sheet whose length in the sheet conveyance direction is a first length is conveyed, the control portion causes the moving portion to move the first roller pair in the sheet width direction based on a detection result by the detection portion, and then causes the first sheet to be conveyed from the first roller pair to the oblique feeding portion through the second roller pair that is in the separation state, and if a second sheet whose length in the sheet conveyance direction is a second length shorter than the first length is conveyed, the control portion causes the moving portion to move the first roller pair in the sheet width direction based on a detection result by the detection portion, and then causes the second sheet to be conveyed from the first roller pair to the oblique feeding portion via the second roller pair that is in the contact state.

Further features of the present invention will become apparent from the following description of exemplary embodiments with reference to the attached drawings.

DESCRIPTION OF THE EMBODIMENTS

Hereinafter, some embodiments of the present disclosure will be described with reference to the accompanying drawings.

Image Forming Apparatus

Figure 1:
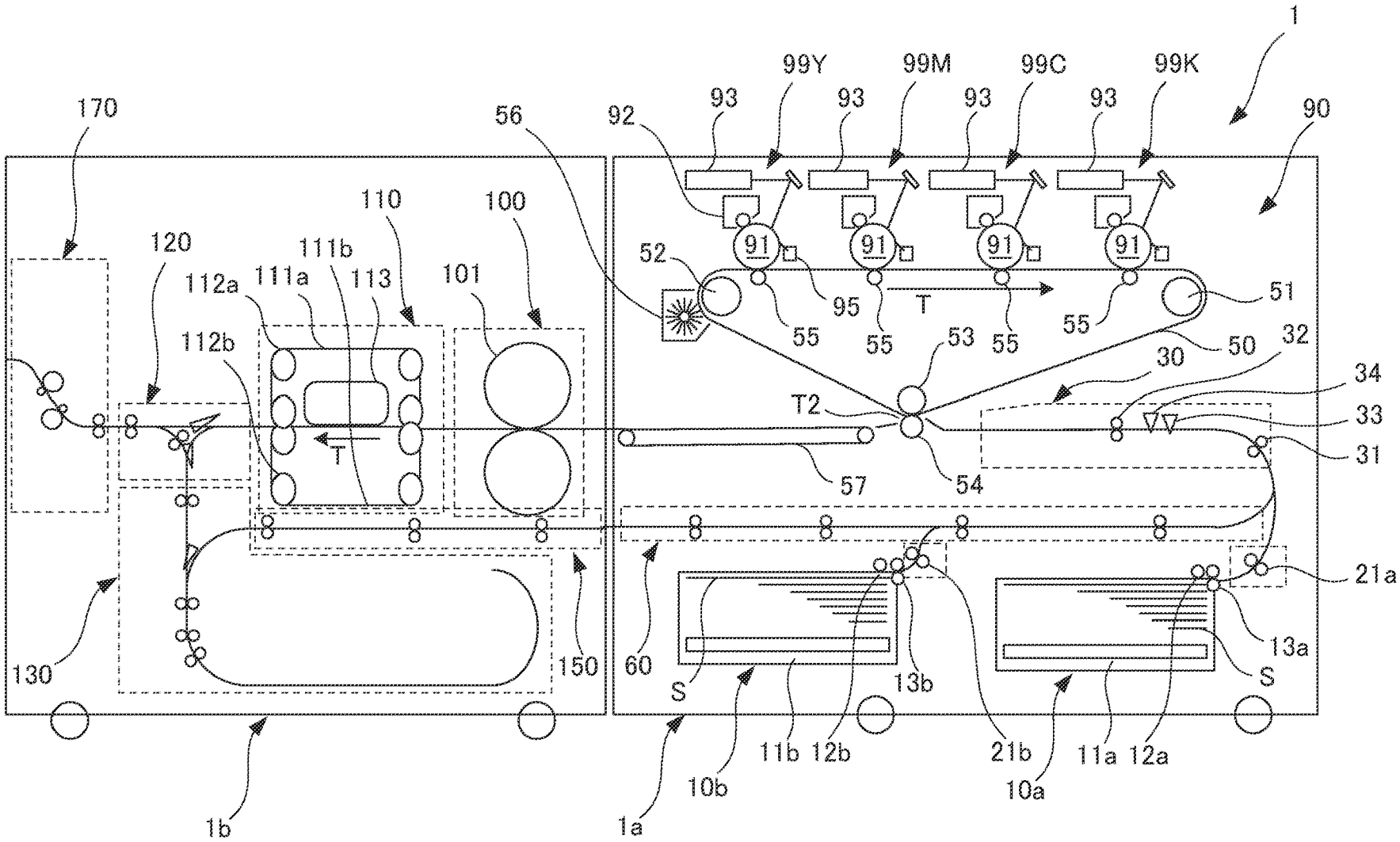
FIG. 1 is a schematic diagram of a printer of one embodiment.

First, a printer 1 that serves as an image forming apparatus of one embodiment will be described. FIG. 1 is a schematic diagram of the printer 1. The printer 1 is an electrophotographic full-color laser beam printer. As illustrated in FIG. 1, the printer 1 includes a first housing 1*a* and a second housing 1*b*. The first housing 1*a* includes a unit for feeding a sheet, and a unit for forming an image on the sheet. The second housing 1*b* includes a unit for fixing an image to a sheet, and a unit for cooling the sheet.

The first housing 1*a* includes feeding units 10*a* and 10*b*, drawing roller pair 21*a* and 21*b*, a registration unit 30, an image forming portion 90, a pre-fixing conveyance unit 57, and a first duplex conveyance unit 60. The image forming portion 90 is an example of an image forming portion that forms an image on a sheet.

The second housing 1*b* includes a fixing unit 100, a cooling unit 110, a branch conveyance unit 120, a reverse conveyance unit 130, a second duplex conveyance unit 150, and a decurling unit 170.

The image forming portion 90 includes four process cartridges 99Y, 99M, 99C, and 99K, and four exposure apparatuses 93. The four process cartridges 99Y, 99M, 99C, and 99K respectively form toner images (hereinafter referred to simply as images) of yellow, magenta, cyan, and black.

The process cartridge 99Y includes a photosensitive drum 91 that serves as an image bearing member, a charger, a development unit 92, and a cleaner 95. The photosensitive drum 91 has an organic photoconductive layer coated on the outer circumferential surface of an aluminum cylinder, and is driven and rotated by a driving motor (not illustrated). The process cartridges 99M, 99C, and 99K have substantially the same configuration as that of the process cartridge 99Y, except that they produce different colors of image.

The image forming portion 90 also includes an intermediate transfer belt 50, which is rotated by a driving roller 52 in a direction indicated by an arrow T. The intermediate transfer belt 50 is an intermediate transfer member of the present embodiment. The intermediate transfer belt 50 is an endless belt member, and is wound around a tension roller 51, the driving roller 52, and a secondary transfer inner roller 53. Inside the intermediate transfer belt 50, four primary transfer rollers 55 that correspond to the respective photosensitive drums 91 are disposed. Outside the intermediate transfer belt 50, a secondary transfer outer roller 54 is disposed so as to face the secondary transfer inner roller 53. A secondary transfer portion T2 is formed, as a nip portion, between the secondary transfer outer roller 54 and the secondary transfer inner roller 53. The secondary transfer portion T2 serves as a transfer portion in which an image is transferred to a sheet. In addition, a belt cleaner 56 is disposed in contact with the outer surface of the intermediate transfer belt 50.

The pre-fixing conveyance unit 57 is a conveyance unit that conveys a sheet S from the secondary transfer portion T2 toward a sheet discharging outlet, which is disposed in a side surface of the first housing 1*a* (i.e., a side surface of the first housing 1*a* on the second housing 1*b* side). The first duplex conveyance unit 60 is a conveyance unit that receives a sheet S from the second housing 1*b* and conveys the sheet S toward the registration unit 30. Part of the first duplex conveyance unit 60 is used as a conveyance path of a sheet S fed from the feeding unit 10*b*.

The feeding unit 10*a* includes a lift plate 11*a*, a pickup roller 12*a*, and a separation roller pair 13*a*. The lift plate 11*a* moves up and down in a state where a sheet S is stacked on the lift plate 11*a*. The pickup roller 12*a* feeds the sheet S stacked on the lift plate 11*a*. The separation roller pair 13*a* separates sheets, one by one, fed by the pickup roller 12*a*. Similarly, the feeding unit 10*b* includes a lift plate 11*b*, a pickup roller 12*b*, and a separation roller pair 13*b*. The lift plate 11*b* moves up and down in a state where a sheet S is stacked on the lift plate 11*b*. The pickup roller 12*b* feeds the sheet S stacked on the lift plate 11*b*. The separation roller pair 13*b* separates sheets, one by one, fed by the pickup roller 12*b*.

The feeding units 10*a* and 10*b* are an example of a feeding unit that feeds a sheet S to the image forming portion 90. Note that a manual feeding apparatus may be used as the feeding unit. In this case, the manual feeding apparatus feeds a sheet from a manual feed tray (multipurpose tray) disposed, for example, in a side-face portion of the first housing 1*a* such that the manual feed tray can be opened and closed. In addition, a large-capacity feeding apparatus (i.e., an option feeder) connected with the first housing 1*a* may be used as the feeding unit. The sheet S, which serves as a recording material, may be a paper sheet, such as a plain paper sheet or a thick paper sheet, a plastic film, a cloth sheet, a sheet material, such as a coated paper sheet, on which certain surface treatment has been performed, a specially-shaped sheet material, such as an envelope or an index paper sheet, or any one of a variety of sheets having different sizes and materials.

The registration unit 30 is a sheet conveyance apparatus that conveys the sheet S fed from the feeding unit 10*a* or 10*b*, toward the secondary transfer portion T2. The registration unit 30 includes a plurality of conveyance roller pairs 31 and 32, a conveyance sensor 33, and a contact image sensor (CIS) 34. The conveyance sensor 33 detects a position of the sheet S in the conveyance direction. The CIS 34 detects a position of the sheet Sin the width direction. The detailed description of the registration unit 30 will be made below.

The fixing unit 100 is a heat-fixing fixing apparatus. The fixing unit 100 includes a fixing roller pair 101 constituted by a heating roller and a pressing roller, and a heating portion for heating the heating roller. The heating portion may be a halogen lamp, an induction heating mechanism, or the like.

The cooling unit 110 includes an upper cooling belt 111*a* and a lower cooling belt 111*b*. The upper cooling belt 111*a* is rotated by a driving roller 112*a* in a direction indicated by an arrow T, and the lower cooling belt 111*b* is rotated by a driving roller 112*b* so as to rotate together with the upper cooling belt 111*a*. In addition, a heatsink 113 is disposed in contact with the inner surface of the upper cooling belt 111*a*. The heatsink 113 receives heat from the sheet S via the upper cooling belt 111*a* and dissipates the heat, so that the sheet S is cooled.

The branch conveyance unit 120 includes a conveyance path that branches the conveyance path of the sheet S, and a switching guide that switches the conveyance path. The reverse conveyance unit 130 receives the sheet S from the branch conveyance unit 120, and switch-backs the sheet S. Then the reverse conveyance unit 130 sends the sheet S back to the branch conveyance unit 120, or to the second duplex conveyance unit 150. The second duplex conveyance unit 150 is connected with the first duplex conveyance unit 60 of the first housing 1*a*. The decurling unit 170 includes a decurling roller pair constituted by a hard roller with a small diameter and a soft roller with a large diameter. The decurling unit 170 serves as a correction portion that corrects bend (curl) of the sheet on which an image has been formed.

Image Forming Operation

Next, an image forming operation of the printer 1 will be described. When a control portion of the printer 1 receives image information from an external apparatus (not illustrated), the control portion starts the below-described image forming operation. In the image forming portion 90, the rotation of the photosensitive drums 91 and the intermediate transfer belt 50 is started. In addition, image signals (video signals) based on the image information are sent from the control portion to the exposure apparatuses 93, and then the exposure apparatuses 93 emit laser beams produced in accordance with the image signals, to the photosensitive drums 91. With this operation, the surfaces of the photosensitive drums 91, which are charged in advance by the chargers so as to have predetermined polarity and potential, are exposed to the laser beams, and electrostatic latent images are formed on the surfaces of the photosensitive drums 91. The development units 92 develop the electrostatic latent images by using developers that contain toner, and form images on the surfaces of the respective photosensitive drums 91.

The image formed on the photosensitive drum 91 of each of the process cartridges 99Y, 99M, 99C, and 99K is primary-transferred onto the intermediate transfer belt 50 by the primary transfer roller 55. Specifically, multiple-transfer is performed such that one image is put on another, so that a full-color image is formed on the intermediate transfer belt 50. The image borne on the intermediate transfer belt 50 is conveyed, by the rotation of the intermediate transfer belt 50, to the secondary transfer portion T2. The toner that was not transferred to the intermediate transfer belt 50 and that is left on the photosensitive drums 91 are collected by the cleaners 95.

In parallel with the image forming operation performed in the image forming portion 90, the sheet S is fed, one by one, from one of the feeding units 10*a* and 10*b*, and is conveyed to the registration unit 30 through the drawing roller pair 21*a* or 21*b*.

The registration unit 30 corrects the positional deviation and the skew of the sheet S, and conveys the sheet S to the secondary transfer portion T2 at a predetermined conveyance timing. In the secondary transfer portion T2, an image is transferred from the intermediate transfer belt 50 to the sheet S by the transfer voltage applied to the secondary transfer outer roller 54. The toner that was not transferred to the sheet S and that is left on the intermediate transfer belt 50 is collected by the belt cleaner 56.

The sheet S having passed through the secondary transfer portion T2 is conveyed to the fixing unit 100 by the pre-fixing conveyance unit 57. The fixing unit 100 performs a fixing process on the sheet S. Specifically, the fixing unit 100 heats and presses the image formed on the sheet S, while causing the fixing roller pair 101 to nip and convey the sheet S. With this operation, the toner is melted and then solidifies, so that the image is fixed to the sheet S. The sheet S having passed through the fixing unit 100 is cooled by the cooling unit 110 while conveyed by the upper cooling belt 111*a* and the lower cooling belt 111*b*.

After that, path selection is performed by the branch conveyance unit 120 for conveying the sheet S to the decurling unit 170 (i.e., a discharging path) or to the reverse conveyance unit 130 (i.e., a reversing path). If an image is formed on only one side (first side) of the sheet S, the sheet S on which the image is formed on the first side is conveyed from the branch conveyance unit 120 to the decurling unit 170, then decurled, and then discharged to the outside of the apparatus, as a product. Note that in a case where an optional apparatus, such as a finisher or a large-capacity stacker, is connected to the second housing 1*b*, the sheet S that serves as a product is delivered to the optional apparatus.

If images are to be formed on both sides of the sheet S, the sheet S on which the image is formed on the first side is conveyed to the reverse conveyance unit 130 by the branch conveyance unit 120, and then switch-backed and conveyed by the reverse conveyance unit 130. Then, the sheet S is conveyed from the reverse conveyance unit 130 to the registration unit 30 through the second duplex conveyance unit 150 and the first duplex conveyance unit 60. After that, while the sheet S passes through the secondary transfer portion T2 and the fixing unit 100, an image is formed on the second side of the sheet S by using the same method as that for forming an image on the first side. Then, the sheet S on which the images are formed on the first and the second sides is conveyed from the branch conveyance unit 120 to the decurling unit 170, then decurled, and then discharged to the outside of the apparatus as a product, or delivered to an optional apparatus.

Note that the sheet may be discharged to the outside of the apparatus such that a surface of the sheet, on which an image is formed immediately before the sheet is discharged, faces downward (so-called face-down output). In this case, the sheet that serves as a product is switch-backed in the reverse conveyance unit 130, and is delivered to the decurling unit 170.

Registration Unit

Figure 2:
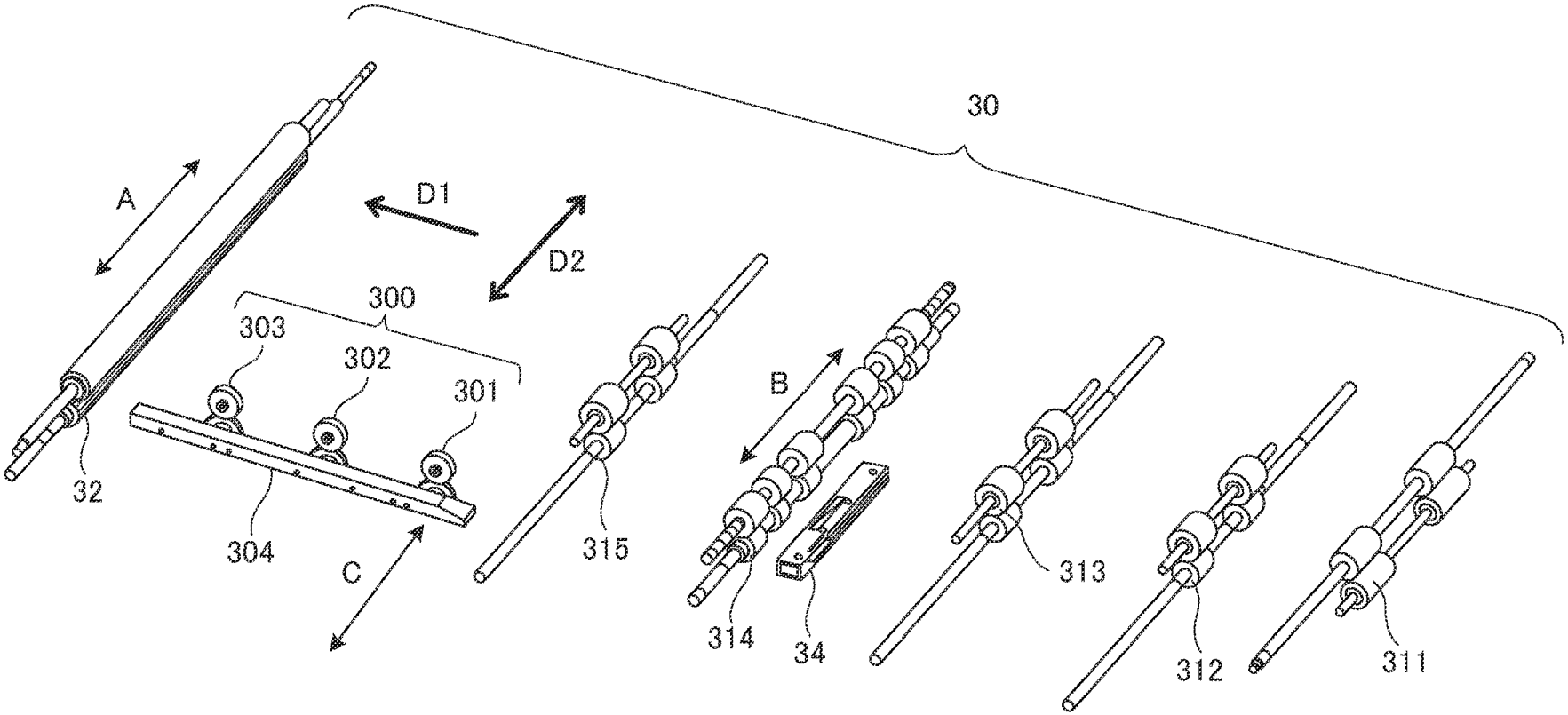
FIG. 2 is a perspective view of a registration unit of the embodiment.
Figure 3:
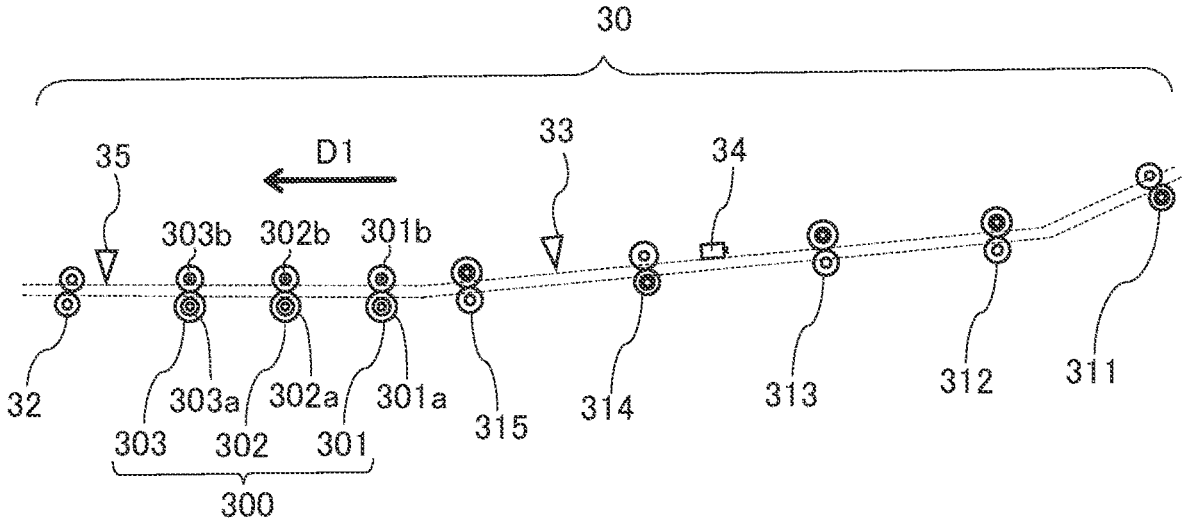
FIG. 3 is a side view of the registration unit of the embodiment.
Figure 4:
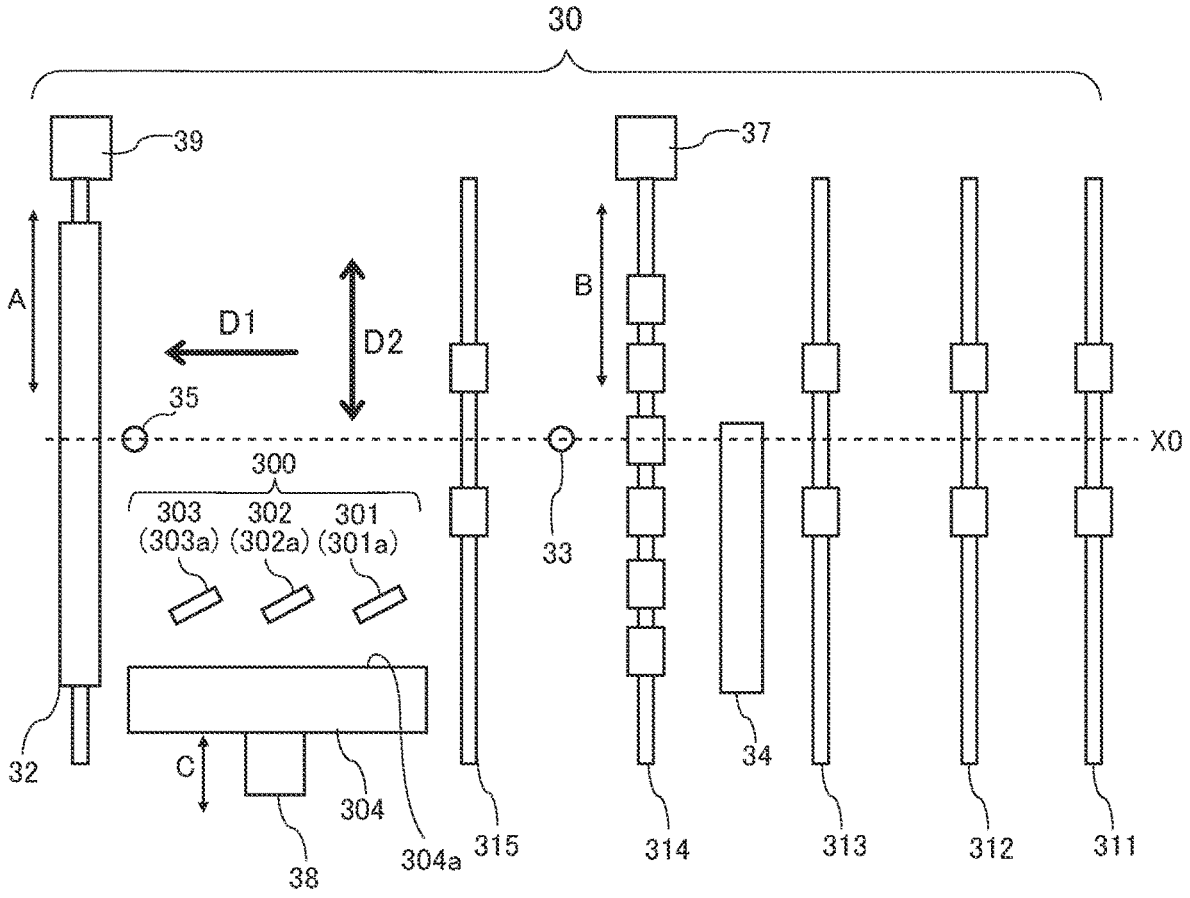
FIG. 4 is a top view of the registration unit of the embodiment.

Next, a specific configuration of the registration unit 30, which is a sheet conveyance apparatus of the present embodiment, will be described. FIG. 2 is a perspective view of the registration unit 30. FIG. 3 is a side view of the registration unit 30 viewed from one side of a sheet width direction D2. FIG. 4 is a top view of the registration unit 30. In FIGS. 2 to 4, conveyance guides that form a sheet conveyance path, bearing members that bear the rollers, and the like are not illustrated.

In the following description, a direction in which the sheet is conveyed along the sheet conveyance path in the registration unit 30 is defined as a sheet conveyance direction D1. In addition, a direction orthogonal to the sheet conveyance direction D1 is defined as the sheet width direction D2. The sheet width direction D2 is a main scanning direction in the image formation, and the sheet conveyance direction D1 is a sub-scanning direction in the image formation.

As illustrated in FIGS. 2 to 4, the registration unit 30 includes conveyance roller pairs 311, 312, and 313, a pre-registration roller pair 314, and a relay roller pair 315. In addition, the registration unit 30 includes oblique-feeding roller pairs 301, 302, and 303, and a registration roller pair 32. In addition, the registration unit 30 includes slide mechanisms 37, 38, and 39, a side reference plate 304, a conveyance sensor 33, the CIS 34, and a registration sensor 35. The oblique-feeding roller pairs 301 to 303 constitute an oblique feeding unit 300 that obliquely conveys the sheet and causes the sheet to abut against the side reference plate 304.

The pre-registration roller pair 314 is an example of a first roller pair. The relay roller pair 315 is an example of a second roller pair disposed downstream of the first roller pair in the sheet conveyance direction D1. The slide mechanism 37 of the pre-registration roller pair 314 is an example of a moving portion. The separation mechanism of the relay roller pair 315 is an example of a contact/separation portion. The oblique feeding unit 300 is an example of an oblique feeding portion. An abutment surface 304*a* of the side reference plate 304 is an example of an abutment portion. The CIS 34 is an example of a detection portion (position detection portion) that detects the position of the sheet in the sheet width direction D2. The first conveyance roller pair 311 is an example of an upstream roller pair disposed upstream of the first roller pair in the sheet conveyance direction D1.

The second conveyance roller pair 312, the third conveyance roller pair 313, the pre-registration roller pair 314 (i.e., a fourth conveyance roller pair), and the relay roller pair 315 (i.e., a fifth conveyance roller pair) are disposed in this order, toward a downstream direction extending from the first conveyance roller pair 311 in the sheet conveyance direction D1. In addition, the first oblique-feeding roller pair 301, the second oblique-feeding roller pair 302, the third oblique-feeding roller pair 303, and the registration roller pair 32 are disposed in this order, toward a downstream direction extending from the relay roller pair 315 in the sheet conveyance direction D1. The registration unit 30 conveys the sheet such that each one of the plurality of roller pairs delivers the sheet to another in a direction extending from the upstream side toward the downstream side in the sheet conveyance direction D1.

Note that the distance from the relay roller pair 315 to the most-upstream oblique-feeding roller pair 301 of the oblique feeding unit 300 in the sheet conveyance direction D1 is set shorter than the distance from the pre-registration roller pair 314 to the relay roller pair 315 in the sheet conveyance direction D1. In other words, the distance from the second roller pair to the first oblique-feeding roller pair in the sheet conveyance direction is shorter than the distance from the first roller pair to the second roller pair in the sheet conveyance direction. As described below, with this setting, a sheet with a small sheet length can also be reliably delivered from the relay roller pair 315 (i.e., the second roller pair) to the oblique feeding unit 300, in a conveyance mode in which the relay roller pair 315 is in a contact state.

The second conveyance roller pair 312, the third conveyance roller pair 313, the pre-registration roller pair 314, the relay roller pair 315, and the oblique-feeding roller pairs 301 to 303 can be respectively brought into a contact state and a separation state by the separation motors 511 to 517. That is, the state of each conveyance roller pair can be switched between the contact state (nip state, pressing state) and the separation state (open state, pressure release state). In the contact state, the rollers of each conveyance roller pair are in contact with each other so that the rollers can nip and convey the sheet. In the separation state, the rollers of each conveyance roller pair are separated from each other. The state of each conveyance roller pair can be switched between the contact state and the separation state, independently from each other. Note that in the separation state, the clearance between the rollers is not necessarily produced. That is, the separation state may be a state where the contact pressure between the rollers is made lower than that in the contact state. Thus, in the separation state, the force applied from the roller pair to the sheet does not substantially affect the conveyance of the sheet.

In the present embodiment, the most-upstream conveyance roller pair 311 and the registration roller pair 32 have no separation mechanism, and are structurally in the contact state.

If at least one of the conveyance roller pairs 312 and 313, of which rollers can be separated from each other, is disposed between the conveyance roller pair 311, which is structurally in the contact state, and the pre-registration roller pair 314, it becomes possible to easily handle a long sheet. That is, when the pre-registration roller pair 314 slides as described below, the roller pair disposed between the conveyance roller pair 311 and the pre-registration roller pair 314 can be separated from the sheet. Note that if the apparatus is required to handle a still longer sheet, the conveyance roller pair 311 may also be separated from the sheet. In contrast, if the upper limit of the sheet length of sheets used for the apparatus is lower than that in the present embodiment, the separation mechanism for the conveyance roller pairs 312 and 313 may not be disposed.

The pre-registration roller pair 314 can be moved (slid) in the sheet width direction D2 by the slide mechanism 37 (as indicated by an arrow B in FIGS. 2 and 4). The detailed description of the slide mechanism 37 will be made below.

The side reference plate 304 includes the abutment surface 304*a* that serves as an abutment portion, and one edge (hereinafter referred to as a side edge) of the sheet in the sheet width direction D2 abuts against the abutment surface 304*a*. The abutment surface 304*a* is a surface that extends in the sheet conveyance direction D1, and that serves as a reference surface for correcting the skew of the sheet (the skew is corrected by the oblique feeding unit 300 causing the side edge of the sheet to abut against the abutment surface 304*a*). When viewed from the upstream side in the sheet conveyance direction D1, the side reference plate 304 has a rectangular shape with one side open in the cross section. Specifically, the side reference plate 304 includes a surface extending from the upper edge of the abutment surface 304*a* toward a side (i.e., an upper side in FIG. 4) opposite to the abutment surface 304*a* in the sheet width direction D2, and a surface extending from the lower edge of the abutment surface 304*a* toward the side opposite to the abutment surface 304*a*. The side reference plate 304 may be molded through die casting, by using aluminum. In addition, the side reference plate 304 can be formed with high accuracy by performing a cutting process on the abutment surface 304*a*. Furthermore, the abutment surface 304*a* may be coated with fluororesin.

In the present embodiment, the side reference plate 304 can be moved in the sheet width direction D2, by the slide mechanism 38 (FIG. 4), as indicated by an arrow C in FIGS. 2 and 4. With this operation, the position of the side reference plate 304 can be adjusted in accordance with a size of the sheet (hereinafter referred to as a sheet width) measured in the sheet width direction D2. Specifically, the side reference plate 304 is positioned at a position separated from a conveyance center line XO (FIG. 4), positioned in the sheet width direction D2, by a predetermined distance. The predetermined distance is obtained by adding a margin necessary for the oblique feeding, to a distance half the sheet width. With this operation, the moving distance of the sheet in the sheet width direction D2, by which the sheet is moved for obliquely feeding the sheet and causing the sheet to abut against the side reference plate 304, becomes substantially constant. As a result, the accuracy of skew correction and the productivity can be increased. Note that the conveyance center line XO is a center line of the sheet conveyance path in the sheet width direction D2, positioned upstream of the pre-registration roller pair 314. Rollers (i.e., outer circumferential portions that contact the sheet) of each of the conveyance roller pairs 311 to 313 are disposed symmetrically with respect to the conveyance center line XO.

The oblique-feeding roller pairs 301, 302, and 303 respectively include oblique feeding rollers 301*a*, 302*a*, and 303*a* that are disposed obliquely with respect to the sheet conveyance direction D1, and driven rollers 301*b*, 302*b*, and 303*b* that face the oblique feeding rollers 301*a*, 302*a*, and 303*a*. The rotation axes of the oblique feeding rollers 301*a*, 302*a*, and 303*a* are each obliquely inclined with respect to the sheet width direction D2. That is, the oblique feeding rollers 301*a*, 302*a*, and 303*a* apply a conveyance force to the sheet in a direction obliquely inclined with respect to the sheet conveyance direction D1, so that the sheet is moved toward one side of the sheet width direction D2 (i.e., the side reference plate 304 side, or the lower side in FIG. 4) as the sheet is conveyed downstream in the sheet conveyance direction D1.

In this manner, the oblique-feeding roller pairs 301, 302, and 303 convey the sheet while moving the sheet toward the side reference plate 304 in the sheet width direction, by applying the conveyance force to the sheet in a direction obliquely inclined with respect to the sheet conveyance direction D1. In addition, even after the side edge of the sheet contacts the abutment surface 304*a* of the side reference plate 304, the oblique-feeding roller pairs 301, 302, and 303 convey the sheet downstream in the sheet conveyance direction D1 while causing the side edge of the sheet to abut against the abutment surface 304*a*. With this operation, the skew of the side edge of the sheet is corrected with reference to the abutment surface 304*a* of the side reference plate 304.

Note that although the rotation-axis directions of the driven rollers 301*b*, 302*b*, and 303*b* are substantially parallel with the sheet width direction D2 in the present embodiment, the driven rollers 301*b*, 302*b*, and 303*b* may also be inclined, like the oblique feeding rollers 301*a*, 302*a*, and 303*a*. In addition, the number and the arrangement of the oblique-feeding roller pairs may be changed as appropriate. For example, another oblique-feeding roller pair may be additionally disposed at a position that is the same as that of the oblique-feeding roller pair 301 in the sheet conveyance direction D1, and that is opposite to the side reference plate 304 with respect to the conveyance center line XO.

Each of the oblique feeding rollers 301*a*, 302*a*, and 303*a* receives driving force from a driving motor via a universal joint or the like, and is driven and rotated by the driving force. The driven rollers 301*b*, 302*b*, and 303*b* are connected to respective separation mechanisms, and are disposed so that they can move with respect to the oblique feeding rollers 301*a*, 302*a*, and 303*a*. Specifically, the driven rollers 301*b*, 302*b*, and 303*b* are disposed so that they can abut against and separate from the oblique feeding rollers 301*a*, 302*a*, and 303*a*, respectively. Each of the separation mechanisms includes an arm and a cam mechanism. The arm can swing, and rotatably supports a corresponding one of the driven rollers 301*b*, 302*b*, and 303*b*. The cam mechanism swings the arm by using the driving force of a separation motor. The arm swings in accordance with the rotation angle of the separation motor, and moves the driven rollers 301*b*, 302*b*, and 303*b*, so that the state of the oblique-feeding roller pairs 301, 302, and 303 switches between a contact state and a separation state.

The registration roller pair 32 can be moved (slid) in the sheet width direction D2 by the slide mechanism 39 (as indicated by an arrow Ain FIGS. 2 and 4). The registration roller pair 32 conveys the sheet S whose skew has been corrected, toward the secondary transfer portion T2 (FIG. 1) in the sheet conveyance direction D1. When the registration roller pair 32 conveys the sheet S, the registration roller pair 32 is controlled so that the registration roller pair 32 moves the sheet, which has been caused to abut against the side reference plate 304 for the skew correction, in the sheet width direction D2 such that the sheet is aligned with a reference position of an image formed by the image forming portion 90. In addition, the registration roller pair 32 is controlled so that the registration roller pair 32 adjusts the timing at which the registration roller pair 32 sends the sheet to the secondary transfer portion T2. Specifically, the registration roller pair 32 adjusts the timing so that the timing is in synchronization with the timing at which an image formed by the image forming portion 90 reaches the secondary transfer portion T2.

The CIS 34 is an example of a detection portion that detects the position of the sheet in the sheet width direction D2. The CIS is an image sensor (i.e., a line sensor) that includes a board, an irradiating portion (that includes T FDs and a light guiding member), and lenses. The board has light receiving elements disposed along the sheet width direction D2; the irradiating portion emits light to the sheet; and the lenses focus the reflected light from the sheet, on the light receiving elements. A below-described controller 550 (FIG. 9) detects the side-edge position of the sheet, depending on the detection result by the CIS 34, before the oblique feeding of the sheet is started. For example, the controller 550 detects the side edge of the sheet from one-dimensional image data captured by the CIS 34, by performing the edge detection process.

Note that the CIS 34 is disposed, shifted toward one side (i.e., the side reference plate 304 side) in the sheet width direction D2, with respect to the conveyance center line XO (FIG. 4). This is because it is sufficient that the side-edge position of only one side of the sheet is detected, for correcting the position of the sheet by using the detection result by the CIS 34, as described below. In addition, the detection range of the CIS 34 is set so that the side-edge position of a sheet S having the smallest sheet width and the side-edge position of a sheet S having the largest sheet width can be both detected. The smallest sheet size and the largest sheet size are determined in the size of sheets that can be used for the image forming apparatus.

Each of the conveyance sensor 33 and the registration sensor 35 is an example of a sheet detection portion that detects the leading edge and the trailing edge of a sheet. For example, the conveyance sensor 33 is disposed between the pre-registration roller pair 314 and the relay roller pair 315. The registration sensor 35 is disposed in the vicinity of the registration roller pair 32. The below-described controller 550 (FIG. 9) can determine the timing at which the oblique feeding of the sheet is started, depending on the timing at which the conveyance sensor 33 detects the leading edge of the sheet. In addition, the controller 550 can adjust the speed of the registration roller pair 32 in accordance with the timing at which the registration sensor 35 detects the leading edge of the sheet. In addition, the controller 550 can monitor detection signals from the conveyance sensor 33 and the registration sensor 35, and thereby can detect an abnormal state (e.g., sheet-stuck jam) in the sheet conveyance.

For example, the conveyance sensor 33 may be a reflective photoelectric sensor that includes a light emitting portion and a light receiving portion. In this case, the light emitted by the light emitting portion is reflected by the sheet and detected by the light receiving portion, so that the passage timing of the sheet is detected. Note that the conveyance sensor 33 may be another sensor other than the reflective photoelectric sensor. For example, the conveyance sensor 33 may be a known sensor that is a combination of a flag and a photoelectric sensor. In this case, the flag swings when pressed by the sheet, and the light incident on the photoelectric sensor is blocked by the flag. Like the conveyance sensor 33, the registration sensor 35 may be a known sensor, such as a reflective photoelectric sensor.

Configuration for Controlling Registration Unit

Figure 9:
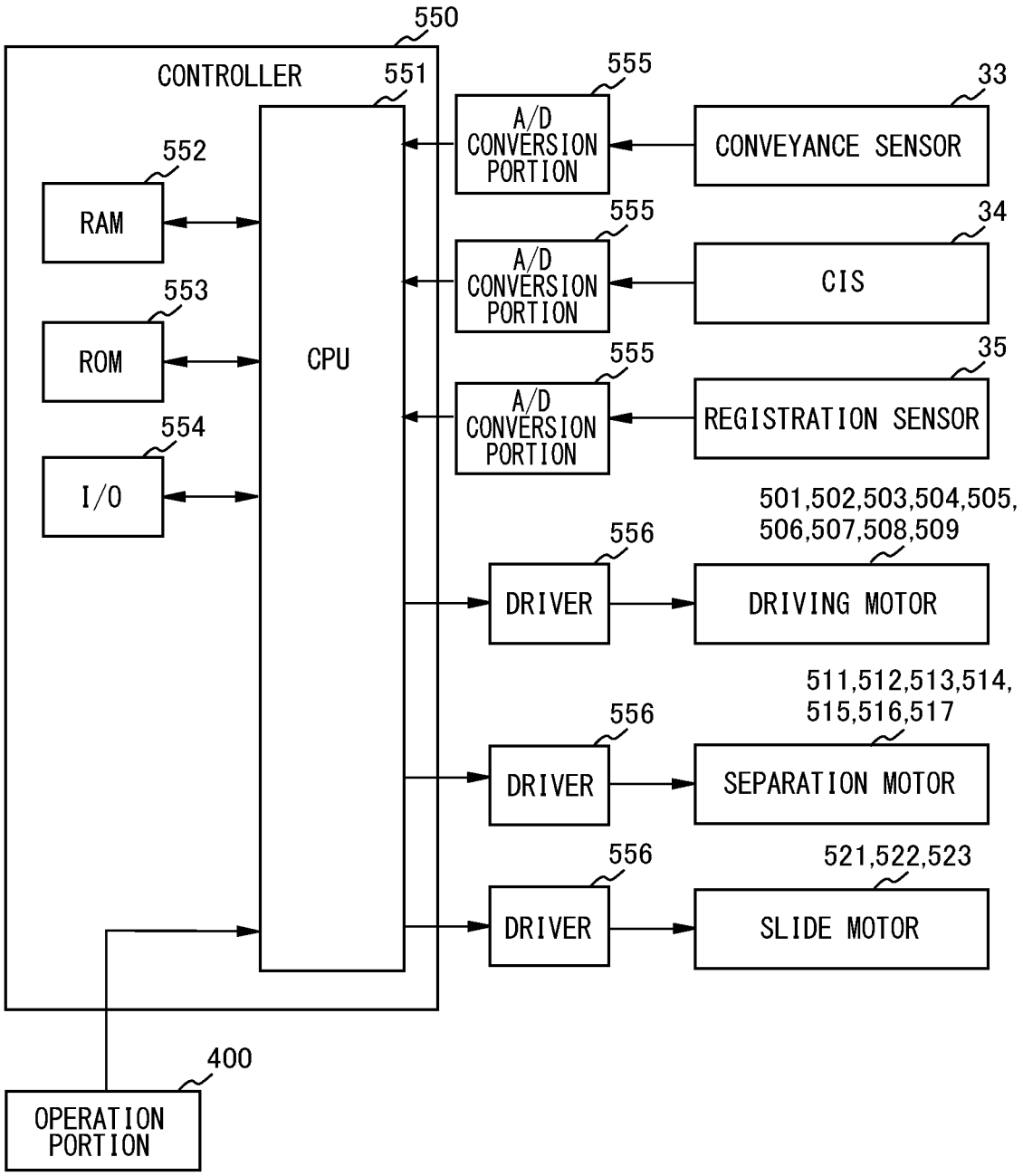
FIG. 9 is a block diagram illustrating a configuration for controlling the registration unit of the embodiment.

Next, a configuration for controlling the registration unit 30 will be described with reference to FIG. 9. The operation of the registration unit 30 is controlled by the controller 550, which is disposed in the printer 1. The controller 550 is one example of a control portion, and includes a CPU 551 that serves as an execution portion that executes a program, a RAM 552 and a ROM 553 that serve as a storage portion, and an interface (I/O) 554 that serves as an interface between the CPU 551 and an external apparatus or a network.

The CPU 551 loads a program stored in the ROM 553 or the like, and executes the program. With this operation, the CPU 551 can execute each process of a control method, which will be described, for example, with reference to a flowchart of FIG. 10. The ROM 553 is an example of a computer-readable non-transitory storage medium that stores a program for controlling the sheet conveyance apparatus or the image forming apparatus.

The CPU 551 performs the control, depending on the information inputted by a user via an operation portion 400 that serves a user interface, and on detection signals from the above-described conveyance sensor 33, the CIS 34, and the registration sensor 35. Each of the detection signals from the conveyance sensor 33 and the registration sensor 35 is sent to the CPU 551 via an AD conversion portion 555. In addition, the detection signal from the CIS 34 is sent to the CPU 551 via an AD conversion portion 555. The CPU 551 controls, via drivers 556, a group of motors 501 to 509, 511 to 517, and 521 to 523, which are actuators for the registration unit 30.

The roller pairs of the registration unit 30 are driven and rotated by the driving motors 501 to 509. The driving motors 501, 502, and 503 drive the conveyance roller pairs 311, 312, and 313, respectively. The driving motor 504 drives the pre-registration roller pair 314. The driving motor 505 drives the relay roller pair 315. The driving motors 506, 507, and 508 drive the oblique-feeding roller pairs 301, 302, and 303, respectively. The driving motor 509 drives the registration roller pair 32.

The separation motor 511 causes the rollers of the second conveyance roller pair 312 to abut against and separate from each other. The separation motor 512 causes the rollers of the third conveyance roller pair 313 to abut against and separate from each other. The separation motor 513 causes the rollers of the pre-registration roller pair 314 to abut against and separate from each other. The separation motor 514 causes the rollers of the relay roller pair 315 to abut against and separate from each other. The separation motors 515 to 517 respectively cause the rollers of the first to the third oblique-feeding roller pairs 301 to 303 to abut against and separate from each other.

The slide motor 521 moves (slides) the pre-registration roller pair 314 in the sheet width direction D2, by driving the slide mechanism 37 (FIG. 4). The slide motor 522 moves (slides) the side reference plate 304 in the sheet width direction D2, by driving the slide mechanism 38 (FIG. 4). The slide motor 523 moves (slides) the registration roller pair 32 in the sheet width direction D2, by driving the slide mechanism 39 (FIG. 4).

For example, the above-described motors 501 to 509, 511 to 517, and 521 to 523 may be stepping motors whose rotation angle can be controlled with high accuracy.

Detailed Description of Conveyance Roller Pair

Figure 11A:
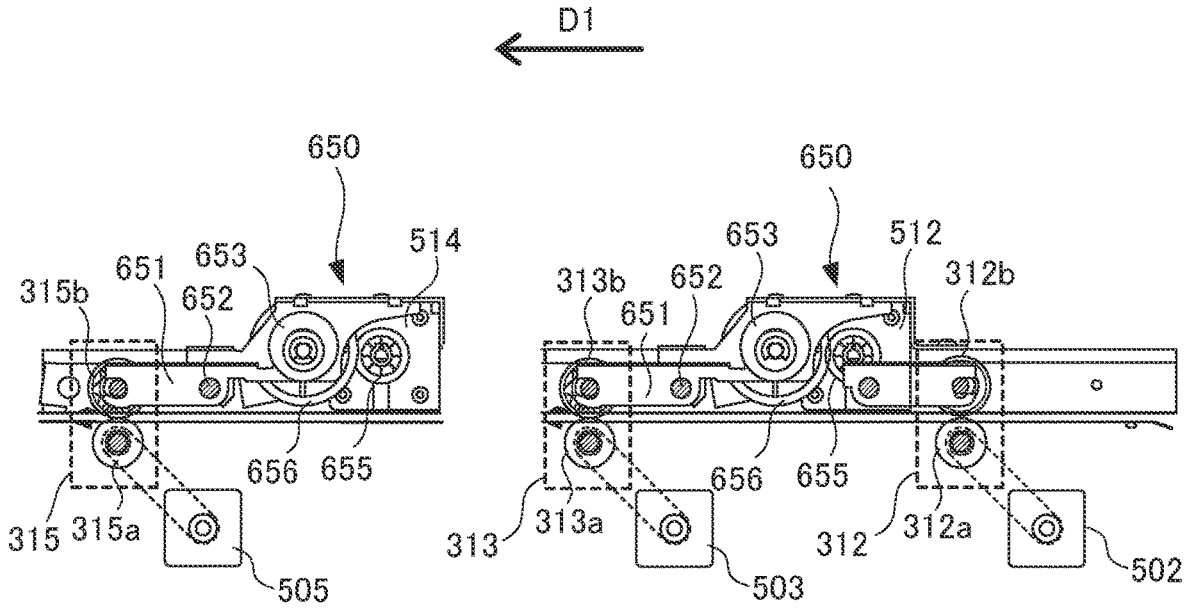
FIG. 11A is a side view for illustrating a configuration for driving a conveyance roller pair of the embodiment.
Figure 11B:
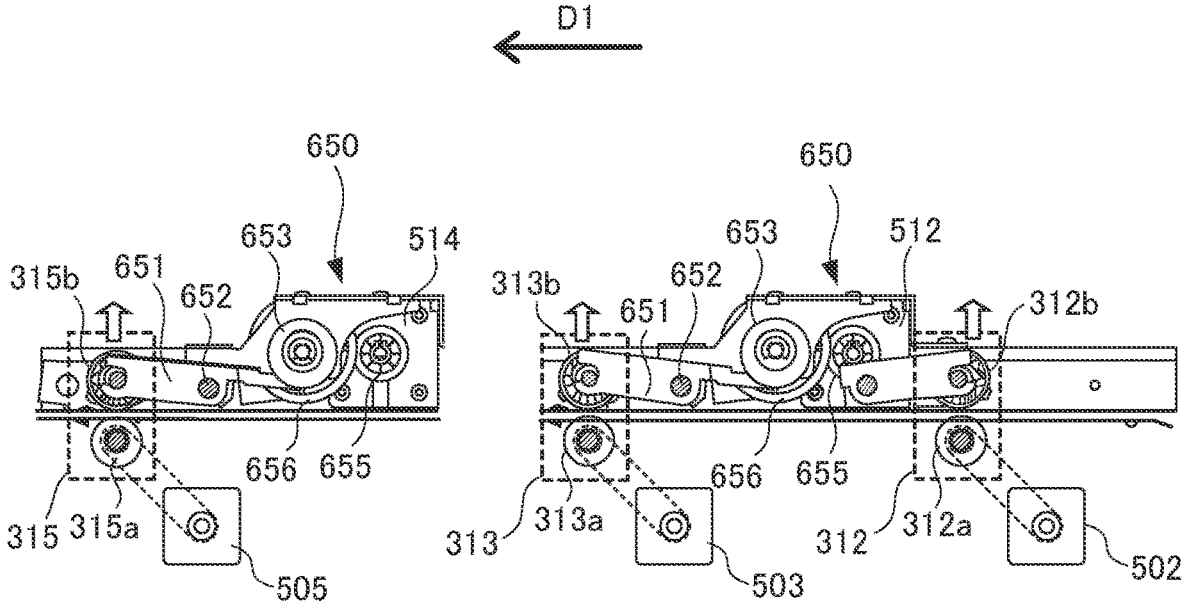
FIG. 11B is a side view for illustrating a configuration for separating the conveyance roller pair of the embodiment.

Next, the conveyance roller pairs 312 and 313 and the relay roller pair 315 will be described in detail with reference to FIG. 11. The conveyance roller pair 312 is constituted by a driving roller 312*a* and a driven roller 312*b*, the conveyance roller pair 313 is constituted by a driving roller 313*a* and a driven roller 313*b*, and the relay roller pair 315 is constituted by a driving roller 315*a* and a driven roller 315*b*.

The driving roller 312*a* is connected with a driving motor 502 via a belt-driven transmission mechanism, the driving roller 313*a* is connected with a driving motor 503 via a belt-driven transmission mechanism, and the driving roller 315*a* is connected with a driving motor 505 via a belt-driven transmission mechanism. Each of the driving motors 502, 503, and 505 is a driving source. In this configuration, the conveyance roller pairs 312 and 313, and the relay roller pair 315 respectively receive the driving force from the driving motors 502, 503, and 505; and rotate. Similarly, the most-upstream conveyance roller pair 311 receives the driving force from the driving motor 501 via a belt-driven transmission mechanism, and rotates. Each of the driven rollers 312*b*, 313*b*, and 315*b* is connected to a separation mechanism 650.

Hereinafter, a configuration and an operation of the separation mechanism 650 for the relay roller pair 315 will be described, as an example. The separation mechanism 650 includes a separation motor 514, gears 655 and 656, an eccentric cam 653, and an arm 651. The arm 651 swings on a swing shaft 652, and supports a rotary shaft of the driven roller 315*b* such that the rotary shaft can rotate. The rotation of the separation motor 514 is transmitted to the eccentric cam 653 via the gears 655 and 656, so that the arm 651 swings in accordance with the rotation of the eccentric cam 653. The driven roller 315*b* is moved upward and downward in FIG. 11, so as to abut against and separate from the driving roller 315*a*, by the swing of the arm 651.

Thus, it is possible to switch the state of the relay roller pair 315 between the contact state and the separation state by controlling the rotation angle of the separation motor 514. A similar separation mechanism 650 is disposed also for each of the conveyance roller pairs 312 and 313. Thus, it is possible to switch the state of each of the conveyance roller pairs 312 and 313 between the contact state and the separation state by controlling the rotation angle of a corresponding one of the separation motors 511 and 512.

Detailed Description of Pre-registration Roller Pair

Figure 12:
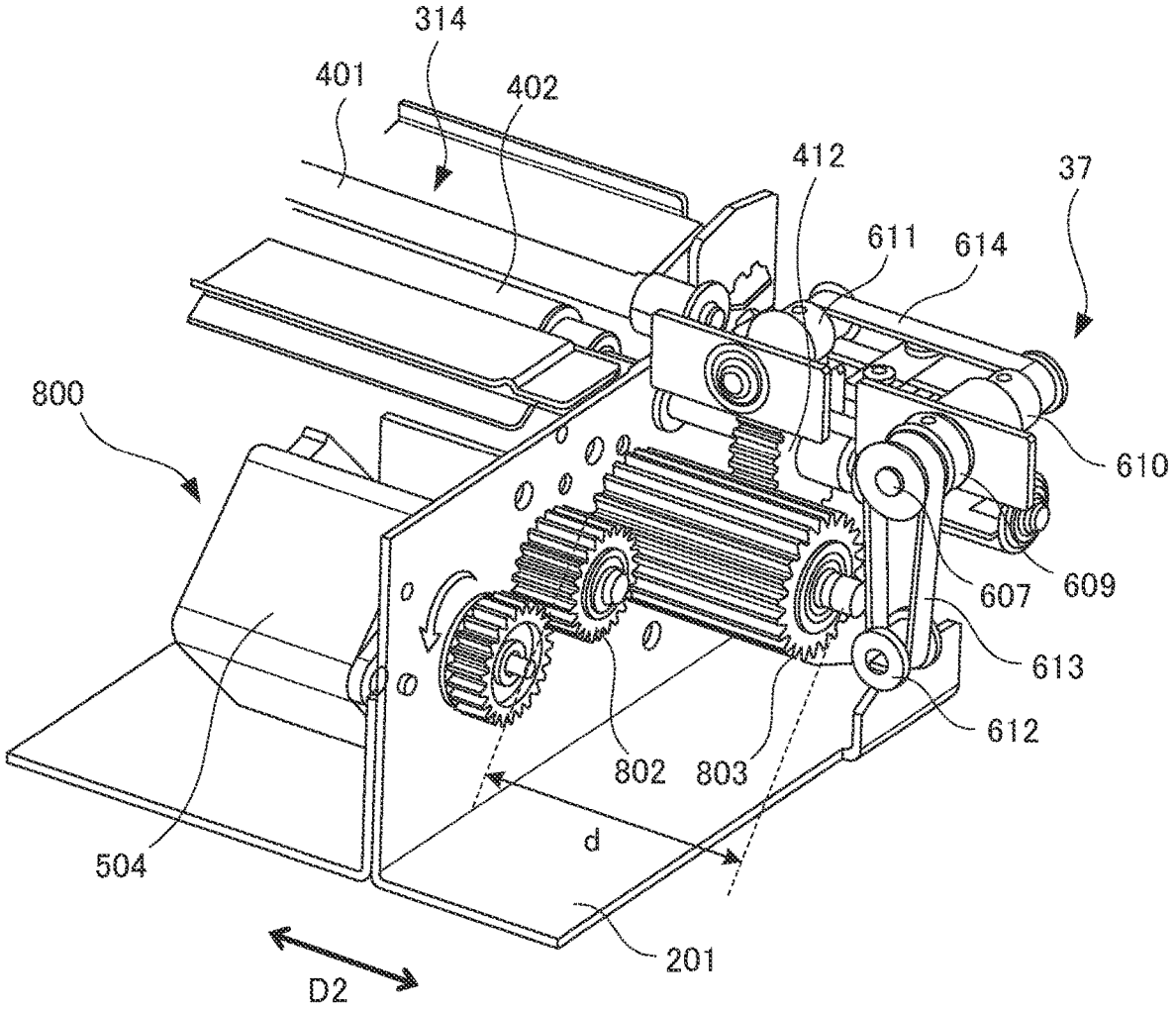
FIG. 12 is a perspective view for illustrating a configuration for driving a pre-registration roller pair of the embodiment.
Figure 13:
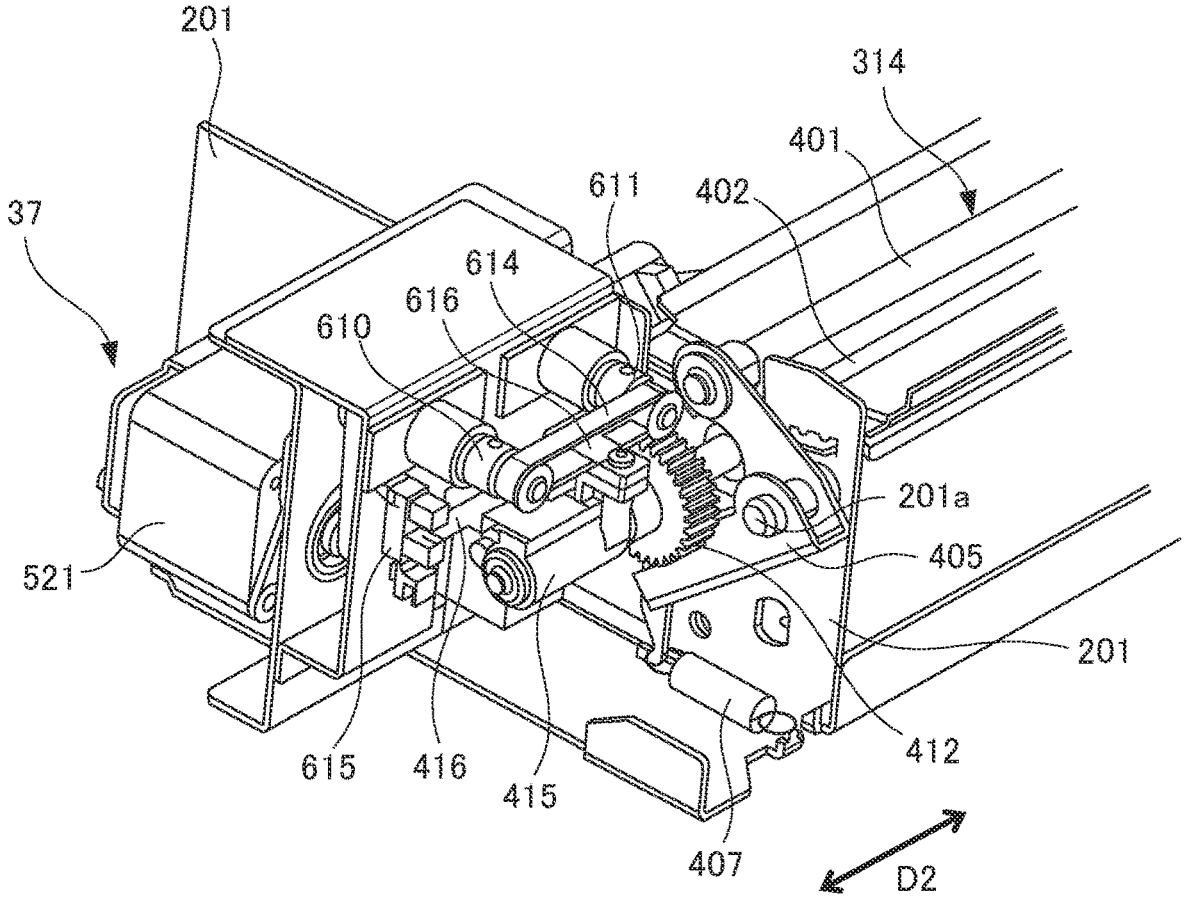
FIG. 13 is a perspective view for illustrating a configuration for sliding the pre-registration roller pair of the embodiment.
Figure 14A:
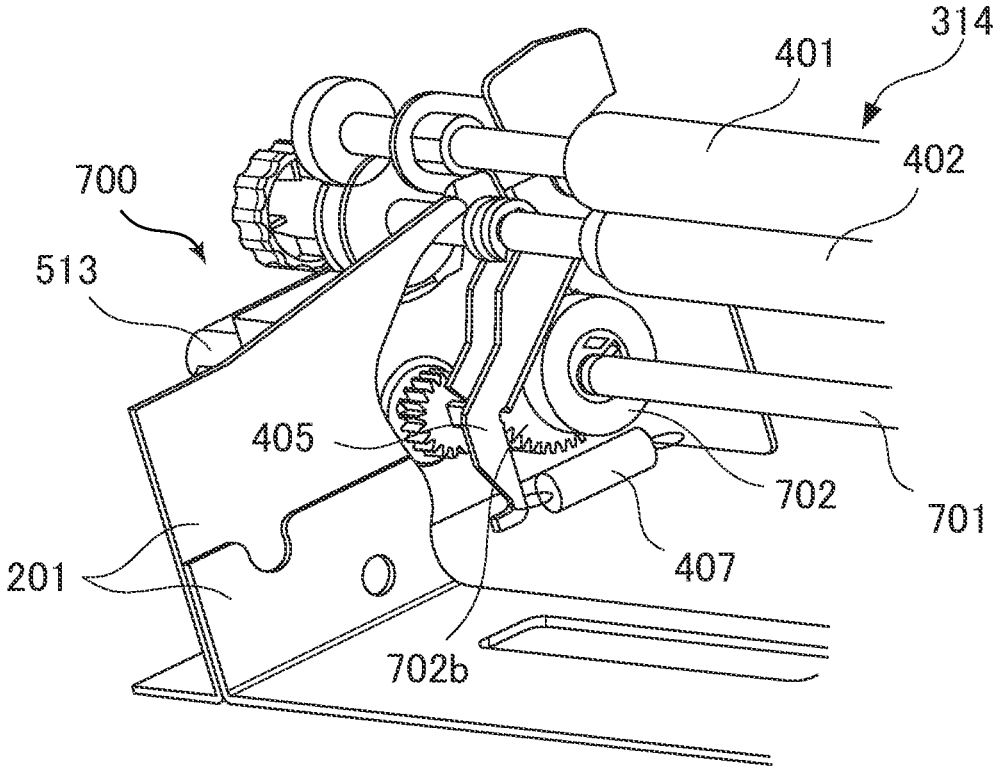
FIG. 14A is a perspective view for illustrating a configuration for separating the pre-registration roller pair of the embodiment.
Figure 14B:
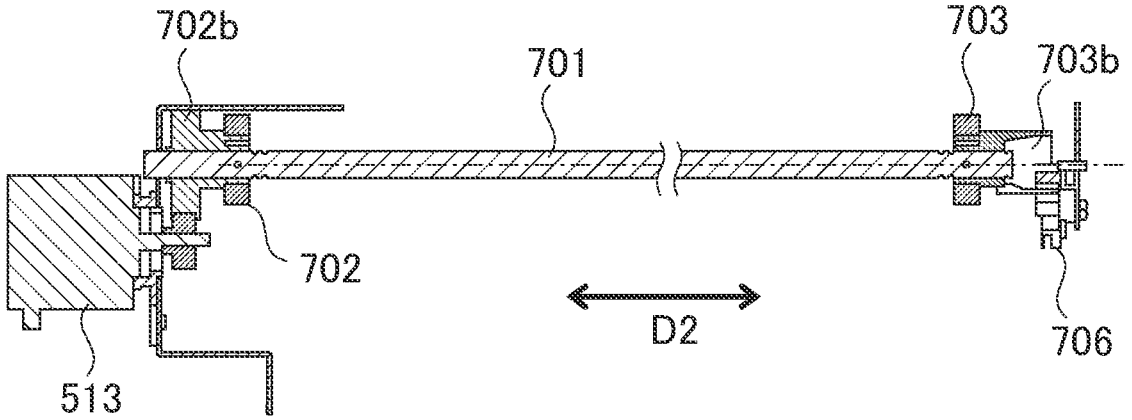
FIG. 14B is a cross-sectional view for illustrating the configuration for separating the pre-registration roller pair of the embodiment.

Next, the pre-registration roller pair 314 will be described in detail with reference to FIGS. 12 to 14. FIG. 12 is a perspective view of a driving mechanism 800 that drives and rotates the pre-registration roller pair 314. FIG. 13 is a schematic perspective view of the slide mechanism 37 that slides the pre-registration roller pair 314. FIG. 14A is an enlarged perspective view of a separation mechanism 700 that switches the state of the pre-registration roller pair 314 between the contact state and the separation state. FIG. 14B is a cross-sectional view of the separation mechanism 700.

The pre-registration roller pair 314 can be driven and rotated by the driving mechanism 800, and moved in the sheet width direction D2 by the slide mechanism 37. In addition, the state of the pre-registration roller pair 314 can be switched between the contact state and the separation state by the separation mechanism 700.

As illustrated in FIGS. 12 and 13, the pre-registration roller pair 314 is constituted by an upper roller 401 and a lower roller 402. The lower roller 402 is rotatably supported by a frame 201 of the printer 1, and the upper roller 401 is rotatably supported by an arm 405 that is one part of the separation mechanism 700.

As illustrated in FIG. 12, the driving mechanism 800 includes a driving motor 504, driving gears 802 and 803, and a roller gear 412. The driving motor 504 is fixed to the frame 201. The roller gear 412 is disposed on the rotation axis of the lower roller 402, and rotates together with the lower roller 402. The driving gears 802 and 803 are rotatably supported by respective shafts fixed to the frame 201, and link the output shaft of the driving motor 504 and the roller gear 412. The rotation of the driving motor 504 is transmitted to the roller gear 412 via the driving gears 802 and 803, so that the lower roller 402 that serves as a driving gear rotates. In this manner, the pre-registration roller pair 314 is driven and rotated.

For keeping the engagement between the driving gear 803 and the roller gear 412 even when the pre-registration roller pair 314 slides, a face width d of the driving gear 803 in the sheet width direction D2 is set larger than the slide stroke of the pre-registration roller pair 314. Note that instead of the configuration in which the pre-registration roller pair 314 is driven via the gear train, the driving motor 504 and the lower roller 402 may be linked with each other via a timing belt. In this case, the driving motor 504 and one part of the frame 201 may slide together with the pre-registration roller pair 314.

As illustrated in FIG. 13, the slide mechanism 37 includes the slide motor 521, pulleys 609, 610, 611, and 612, timing belts 613 and 614, a holder 415, a home position sensor 615, and a separation sensor 706 (FIG. 14B).

The holder 415 rotatably supports an end portion of the lower roller 402 on the roller gear 412 side, and moves together with the lower roller 402 in the axial direction (i.e., the sheet width direction D2). The holder 415 is fixed to the timing belt 614 via a member 616. The timing belt 614 is wound around the pulleys 610 and 611, and stretched by the pulleys 610 and 611 in the sheet width direction D2.

As illustrated in FIG. 12, the pulley 610 is a member formed integrally with the pulley 609. The pulley 609 is linked, via a timing belt 613, with the pulley 612 disposed on the output shaft of the slide motor 521 (FIG. 13). Note that the slide motor 521 is not illustrated in FIG. 12. In such a configuration, the timing belts 613 and 614 rotate in accordance with the forward and reverse rotation of the slide motor 521, and the lower roller 402 moves back and forth in the sheet width direction D2, together with the holder 415.

On the other hand, the upper roller 401 of the pre-registration roller pair 314 is engaged with the lower roller 402 via an engagement member (not illustrated), and moves together with the lower roller 402 in the sheet width direction D2.

The home position sensor 615 is a sensor (e.g., a photointerrupter) that detects a sensor flag 416 disposed on the holder 415, when the pre-registration roller pair 314 is located at a predetermined home position. Thus, the controller 550 can detect the home position of the pre-registration roller pair 314, depending on the detection signal from the home position sensor 615.

As illustrated in FIGS. 14A and 14B, the separation mechanism 700 includes a separation motor 513, an arm 405, a pressing spring 407, cams 702 and 703, and a separation shaft 701. The arm 405 rotatably supports the upper roller 401, and can swing on the shaft 201*a* formed on the frame 201 (FIG. 13). The pressing spring 407 urges the arm 405 toward a direction in which the upper roller 401 abuts against the lower roller 402. Note that the arm 405 and the pressing spring 407 are disposed also on a side opposite to one side (illustrated in FIG. 14A) in the sheet width direction D2.

The cams 702 and 703 are disposed on both end portions of the separation shaft 701 that extends in the sheet width direction D2, and abut against the respective arms 405. In addition, as illustrated in FIG. 14A, a gear 702*b* is formed on the cam 702. The rotation of the separation motor 513 is transmitted to the gear 702*b*, so that the cam 702 rotates, and the other cam 703 also rotates via the separation shaft 701. The rotation of the cams 702 and 703 causes the upper roller 401 to move so as to abut against and separate from the lower roller 402. In this manner, the state of the pre-registration roller pair 314 is switched between the contact state and the separation state in accordance with the rotation angle of the separation motor 513.

As illustrated in FIG. 14B, a sensor flag 703*b* to be detected by a separation sensor 706 is formed on the cam 703. The separation sensor 706 is a sensor (e.g., a photointerrupter) that detects the sensor flag 703*b* when the separation shaft 701 has a predetermined rotation angle. Thus, the controller 550 can detect the rotation angle of the cams 702 and 703, depending on the detection signal from the separation sensor 706.

The above-described configuration of the separation mechanism (i.e., a contact/separation portion) of each of the roller pairs 312 to 315 is one example. For example, the cams 702 and 703 driven by the separation motor 513 may directly press a bearing portion of the upper roller 401 of the pre-registration roller pair 314. In another case, the separation mechanism that uses a motor may not be used. In this case, the state of the roller pair may be switched between the contact state and the separation state by moving the roller shaft by using a plunger solenoid or the like.

In addition, the slide mechanism 37 of the pre-registration roller pair 314 is one example of the moving portion. For example, the timing belt may not be used. In this case, the pre-registration roller pair 314 may be slid in the sheet width direction D2 by using a mechanism that uses a worm gear or a translation cam.

Reducing Variations in Conveyance Timing by Sliding Pre-registration Roller Pair In the present embodiment, before the sheet is obliquely fed and caused to abut against the side reference plate 304 by the oblique feeding unit 300, the sheet position in the sheet width direction D2 is corrected when the sheet is located upstream of the oblique feeding unit 300. With this operation, the variations in the conveyance timing of the sheet, produced downstream of the side reference plate 304, can be reduced. Hereinafter, the detailed description thereof will be made.

If the position of the sheet varies in the sheet width direction D2 when the oblique feeding unit 300 starts the oblique feeding, the timing at which the side edge of the sheet abuts against the side reference plate 304 varies after the start of the oblique feeding. If the side edge of the sheet is separated more from the side reference plate 304 when the oblique feeding is started, the timing at which the side edge of the sheet abuts against the side reference plate 304 is delayed. In contrast, if the side edge of the sheet is separated less from the side reference plate 304 when the oblique feeding is started, the timing at which the side edge of the sheet abuts against the side reference plate 304 is advanced. If the timing at which the side edge of the sheet abuts against the side reference plate 304 varies, the distance by which the sheet is conveyed by the oblique feeding unit 300 in a state (i.e., a slide state) where the sheet is in contact with the side reference plate 304 varies.

When the sheet is conveyed in the slide state, the sheet receives excess conveyance resistance (frictional resistance) from the side reference plate 304. Thus, the sheet conveyance speed in the sheet conveyance direction D1 decreases. As a result, due to the variations in sheet position in the sheet width direction D2 that are produced when the oblique feeding is started, the timing at which the sheet passes through a predetermined position positioned downstream of the side reference plate 304 varies. For example, the timing at which the registration sensor 35 detects the leading edge of the sheet after the sheet is obliquely fed and caused to abut against the side reference plate 304 varies with respect to the timing at which the conveyance sensor 33 detects the leading edge of the sheet before the oblique feeding is started.

If such variations in the conveyance timing occur, the productivity (throughput) of the sheet conveyance apparatus may decrease. This is because target intervals are set longer in advance for reducing the effect of the variations in the conveyance timing and for conveying the sheet at the constant target intervals. In the configuration of the present embodiment, intervals at which the sheets are conveyed would be set longer so that an image is transferred to sheets in the secondary transfer portion T2 at the constant intervals (at which the sheets are conveyed).

In the present embodiment, however, before the oblique feeding unit 300 starts the oblique feeding, the pre-registration roller pair 314 is moved in the sheet width direction D2, in accordance with the detection result on the sheet position detected by the CIS 34. With this operation, the distance from the side edge of the sheet to the side reference plate 304 obtained when the oblique feeding is started can be made substantially constant. As a result, the distance by which the sheet is conveyed in the slide state becomes substantially constant, and the variations in the timing at which the registration sensor 35 detects the leading edge of the sheet after the sheet is obliquely conveyed and caused to abut against the side reference plate 304 are reduced. In addition, since the variations in the conveyance timing are reduced, the intervals at which the sheets are conveyed through, for example, the secondary transfer portion T2 can be set shorter, which contributes to increasing the productivity of the printer 1.

The detailed description of the movement of the pre-registration roller pair 314, based on the detection result on the sheet position detected by the CIS 34, will be made below.

Figure 10:
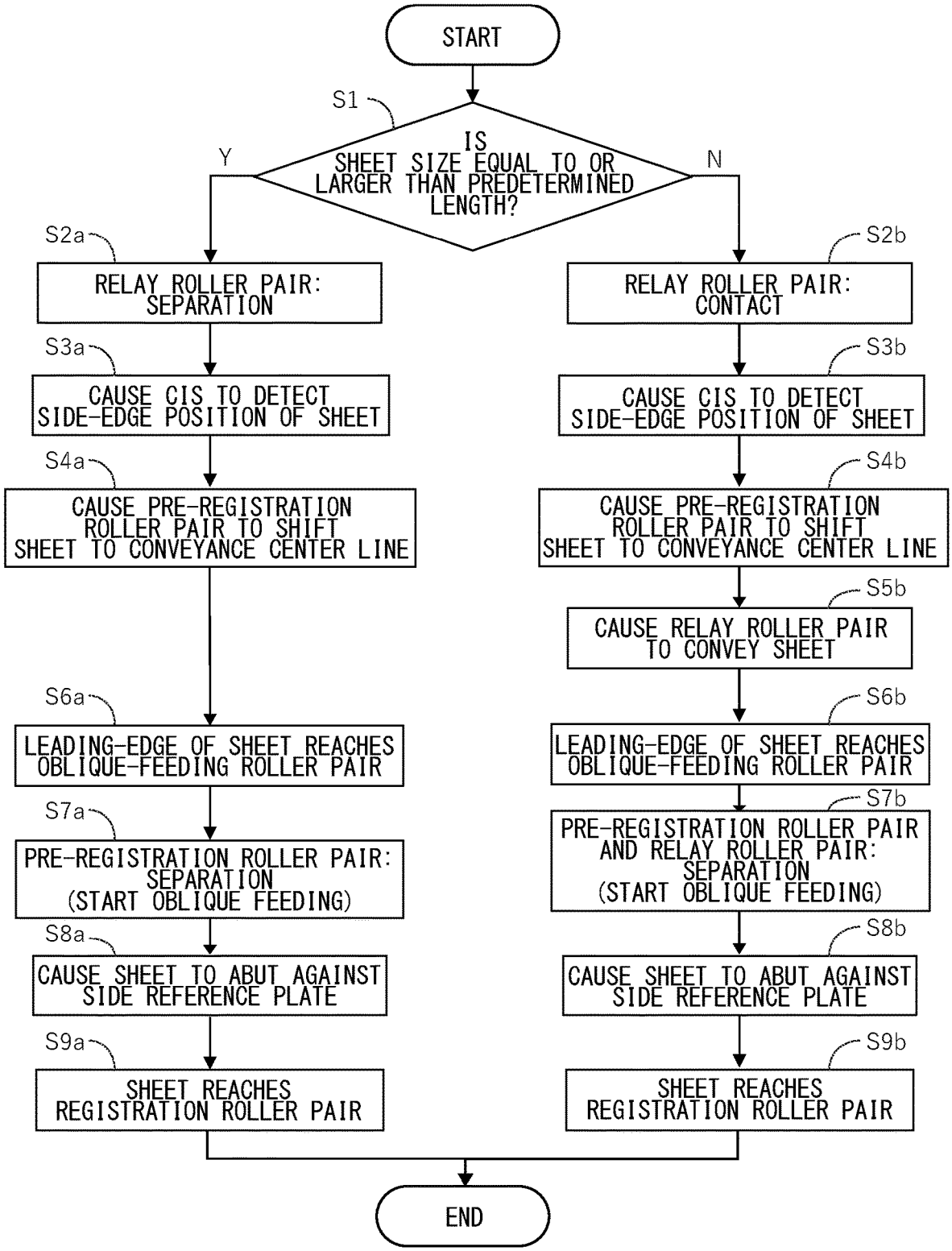
FIG. 10 is a flowchart illustrating a method for controlling the registration unit of the embodiment.

Conveyance Operation for Sheets having Sheet Length of Predetermined Length or More Hereinafter, a conveyance operation performed by the registration unit 30 of the present embodiment in accordance with the size of a sheet (hereinafter referred to as a sheet length) in the sheet conveyance direction will be described with reference to a flowchart of FIG. 10. Each process of the flowchart of FIG. 10 is achieved by the CPU 551 of the controller 550 (FIG. 9) reading a program from the ROM 553 and executes the program. In addition, each process of FIG. 10 is performed as one part of a job when the controller 550 executes the job (print job) for an image forming operation.

First, a conveyance operation performed when the sheet length is equal to or larger than a predetermined length will be described with reference to a flowchart of FIG. 10 and FIGS. 5A to 5D and 6A to 6D. Each of FIGS. 5A to 5D is a top view of the registration unit 30 that illustrates a conveyance operation for a sheet 51 whose sheet length Ls1 is equal to or larger than a predetermined length. Each of FIGS. 6A to 6D is a side view of the registration unit 30 that illustrates the conveyance operation for the sheet 51 whose sheet length Ls1 is equal to or larger than the predetermined length. Note that in FIGS. 5A to 5D, rollers of a roller pair in the contact state are illustrated in black, and rollers of a roller pair in the separation state are illustrated in outline alone.

The information on the sheet size is obtained by the controller 550 in advance before an image forming job is given. The information on the sheet size may be obtained by the controller 500 checking the sheet size information inputted by a user via the operation portion 400 (FIG. 9), or may be automatically detected by sheet size sensors disposed in the feeding units 10*a* and 10*b* (FIG. 1). When an image forming job is given, the controller 550 determines whether the sheet length of a sheet used in a current job is equal to or larger than a predetermined length (51).

Figure 5A:
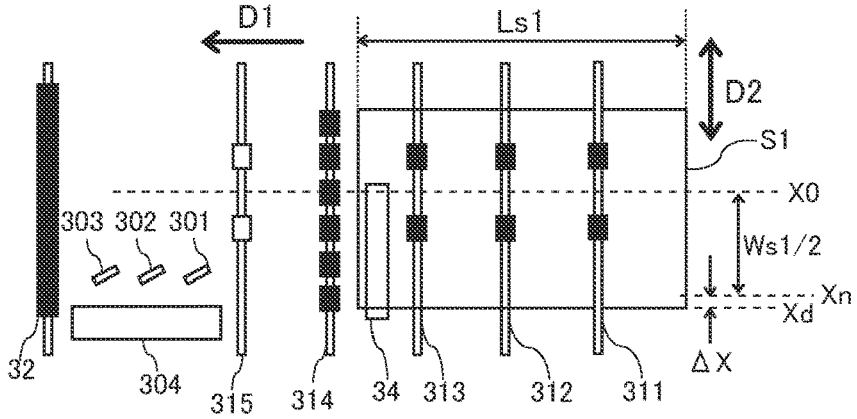
FIG. 5A is a top view illustrating an operation of the registration unit of the embodiment.
Figure 6A:
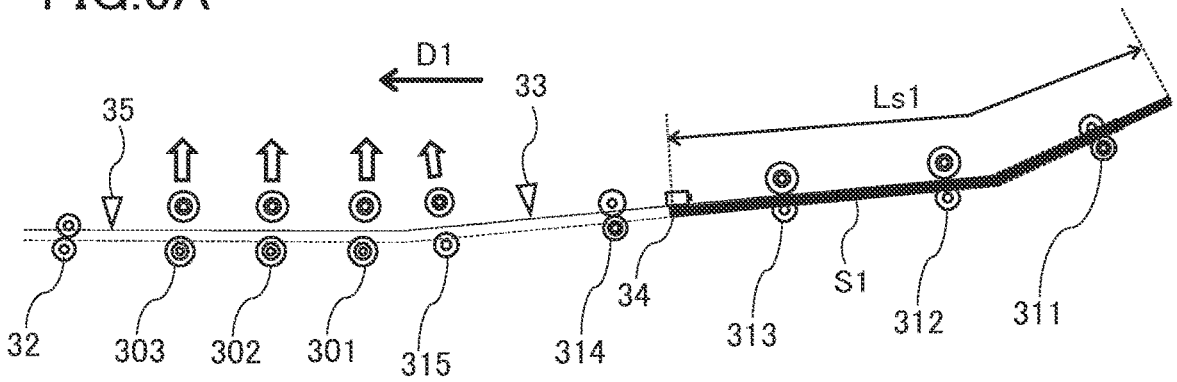
FIG. 6A is a side view illustrating an operation of the registration unit of the embodiment.

If the sheet length is equal to or larger than the predetermined length, then the state of the relay roller pair 315, disposed downstream of the pre-registration roller pair 314, is set to the separation state (S2*a*, FIG. 5A, FIG. 6A). After that, the sheet 51 is conveyed in a conveyance mode (S2*a* to S9*a*) where the relay roller pair 315 (i.e., the second roller pair) is in the separation state.

As illustrated in FIGS. 5A and 6A, the sheet 51 having been conveyed from the conveyance units (i.e., the feeding units 10*a* and 10*b* illustrated in FIG. 1, or the first duplex conveyance unit) disposed upstream of the registration unit 30 is conveyed by the conveyance roller pairs 311 to 313. When the leading edge of the sheet 51 reaches the CIS 34, a side-edge position Xd of the sheet 51 is detected by using the CIS 34 (S3*a*).

Then, the amount of deviation ΔX between the detected side-edge position Xd (FIG. 5A) of the sheet 51 and a target position Xn of the side edge of the sheet 51 is calculated. The target position Xn of the present embodiment is a side-edge position of the sheet S1 whose center line in the sheet width direction D2 is equal to the conveyance center line XO (that is, the target position Xn is a position separated from the conveyance center line XO by half a sheet width Ws1, or is a nominal side-edge position).

Figure 5B:
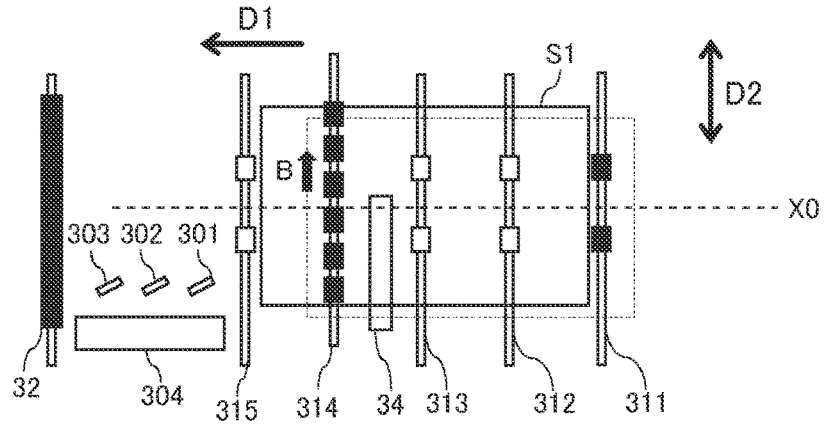
FIG. 5B is a top view illustrating an operation of the registration unit of the embodiment.
Figure 5C:
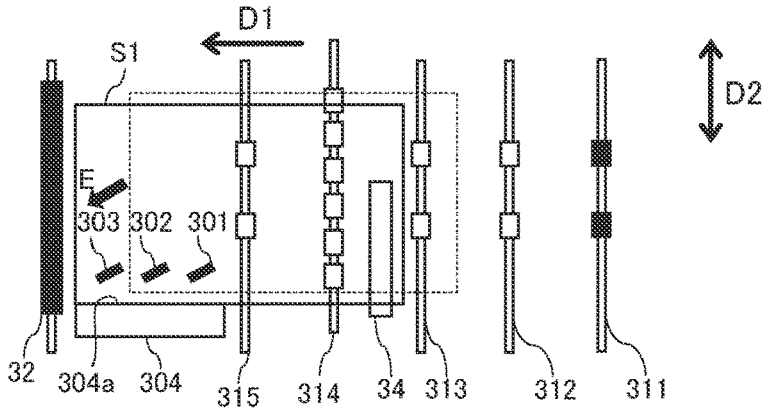
FIG. 5C is a top view illustrating an operation of the registration unit of the embodiment.
Figure 6B:
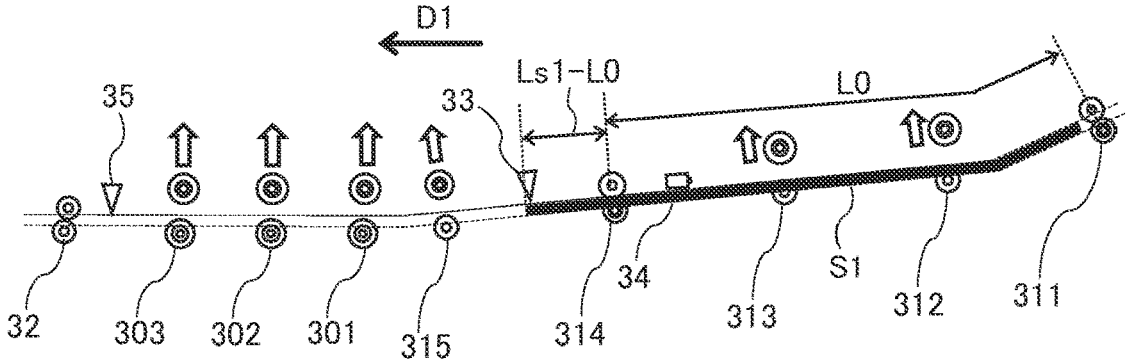
FIG. 6B is a side view illustrating an operation of the registration unit of the embodiment.

Then, the slide operation (shift operation, position correction operation) of the pre-registration roller pair 314 is performed for reducing the amount of deviation ΔX, as indicated by an arrow B in FIG. 5B (S4*a*). Specifically, after the leading edge of the sheet S1 enters the pre-registration roller pair 314, the state of the conveyance roller pairs 312 and 313, which are disposed upstream of the pre-registration roller pair 314, is switched to the separation state (FIG. 6B). Then, after the trailing edge of the sheet S1 passes through the most-upstream conveyance roller pair 311, the controller 550 slides the pre-registration roller pair 314 so that the amount of deviation ΔX is reduced and the side edge of the sheet S1 approaches the target position Xn. With this operation, the sheet position is shifted so that the center line of the sheet S1 is aligned with the conveyance center line XO. The conveyance of the sheet S1 is continued even when the pre-registration roller pair 314 slides.

Note that the pre-registration roller pair 314 slides after the trailing edge of the sheet S1 passes through the most-upstream conveyance roller pair 311. This is because the conveyance roller pair 311 is structurally in the contact state. Specifically, a sheet length Ls1 of the sheet S1 is larger than a path length L0 that extends from the conveyance roller pair 311 to the pre-registration roller pair 314. Thus, when the leading edge of the sheet S1 reaches the pre-registration roller pair 314, the trailing-edge portion of the sheet S1 is still nipped by the conveyance roller pair 311. However, when the leading edge of the sheet S1 is conveyed from the pre-registration roller pair 314 by a distance of Ls1-L0, the trailing edge of the sheet S1 passes through the conveyance roller pair 311. In this state, the trailing edge of the sheet S1 is not retained by the conveyance roller pair 311. Thus, the sheet S1 can be moved in the sheet width direction D2 by the pre-registration roller pair 314, without producing the stress (shear force) in the sheet S1 in the sheet width direction D2.

In addition, the slide of the pre-registration roller pair 314 is ended by the time the sheet is nipped by a roller pair disposed downstream of the pre-registration roller pair 314. In the present embodiment, if the sheet length is equal to or larger than a predetermined length, the state of the relay roller pair 315 is set to the separation state. Thus, the slide of the pre-registration roller pair 314 has only to be ended by the time the leading edge of the sheet S1 reaches the most-upstream oblique-feeding roller pair 301 of the oblique feeding unit 300. With this operation, the period of time in which the pre-registration roller pair 314 can slide is made longer than that in a case where the state of the relay roller pair 315 is in the contact state. As a result, the range in which the position of the sheet S1 can be corrected in the sheet width direction D2 is increased.

Thus, in the present embodiment, if a first sheet (S1) whose sheet length is equal to or larger than a predetermined length is conveyed, the movement of the first roller pair is started by the moving portion (i.e., the slide mechanism 36) after the leading edge of the first sheet reaches the first roller pair (i.e., the pre-registration roller pair 314) and the trailing edge of the first sheet passes through the upstream roller pair (i.e., the conveyance roller pair 311). That is, if the first sheet (S1) whose sheet length is equal to or larger than a predetermined length is conveyed, the movement of the first roller pair is started by the moving portion (i.e., the slide mechanism 36), based on (i) the leading edge of the first sheet having reached the first roller pair (i.e., the pre-registration roller pair 314) and (ii) the trailing edge of the first sheet having passed through the upstream roller pair (i.e., the conveyance roller pair 311). In addition, in the present embodiment, the movement of the first roller pair by the moving portion is ended before the leading edge of the first sheet reaches the oblique feeding portion (i.e., the oblique feeding unit 300). With this operation, the position correction of the first sheet can be completed during a period of time in which the sheet is not retained by any roller pair other than the first roller pair. As a result, the damage to the sheet can be avoided.

Note that if the amount of deviation ΔX calculated by using the CIS 34 is large, and the slide of the pre-registration roller pair 314 cannot be completed by the time the state of the oblique-feeding roller pairs 301 to 303 is switched to the contact state, a user may be notified of the error and the conveyance operation may be stopped.

After the leading edge of the sheet S1 reaches the oblique-feeding roller pair 301, the state of the oblique-feeding roller pairs 301 to 303 is switched to the contact state (S6*a*). In this stage, the force by which the oblique-feeding roller pairs 301 to 303 nip the sheet S1 is weaker than the force by which the pre-registration roller pair 314 nips the sheet S1. Thus, the conveyance force given to the sheet S1 by the pre-registration roller pair 314 is dominant, so that the sheet S1 continues to move in the sheet conveyance direction D1. Note that the timing at which the state of the sheet S1 is switched to the contact state is determined, based on the timing at which the conveyance sensor 33 detects the leading edge of the sheet S1.

Figure 6C:
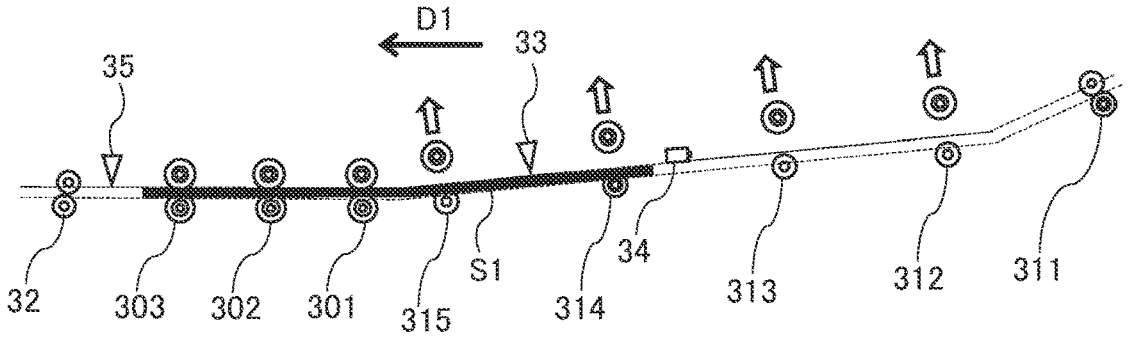
FIG. 6C is a side view illustrating an operation of the registration unit of the embodiment.

After that, the state of the pre-registration roller pair 314 is switched to the separation state (S7*a*, FIG. 6C). With this operation, the oblique conveyance force given to the sheet S1 by the oblique-feeding roller pairs 301, 302, and 303 becomes dominant, and the sheet S1 is conveyed while moving toward the side reference plate 304 in the sheet width direction (as indicated by an arrow E in FIG. 5C).

In the present embodiment, the rollers of the pre-registration roller pair 314 are separated from each other after the leading edge of the sheet S1 reaches the second oblique-feeding roller pair 302. That is, the rollers of the pre-registration roller pair 314 are separated from each other in a state where the sheet S1 is nipped by the most-upstream oblique-feeding roller pair 301 (i.e., the first oblique-feeding roller pair) and the second oblique-feeding roller pair 302 (i.e., the second oblique-feeding roller pair). With this operation, the sheet S1 can be delivered more reliably from the pre-registration roller pair 314 to the oblique feeding unit 300. Note that the state of the oblique-feeding roller pairs 301 to 303 may be switched to the contact state after the leading edge of the sheet S1 reaches the second oblique-feeding roller pair 302. In this case, a period of time in which the sheet S1 slips on the oblique feeding rollers 301*a* and 301*b* can be shortened.

After the side edge of the sheet S1 abuts against the abutment surface 304*a* of the side reference plate 304 (S8*a*), the oblique-feeding roller pairs 301 to 303 slip, and the sheet S1 pivots in accordance with the abutment surface 304*a*. In this manner, the skew of the sheet S1 is corrected. Even after the skew of the sheet S1 is corrected, the oblique-feeding roller pairs 301 to 303 convey the sheet S1 in the sheet conveyance direction D1, while causing the side edge of the sheet S1 to be in contact with the abutment surface 304*a*.

Figure 5D:
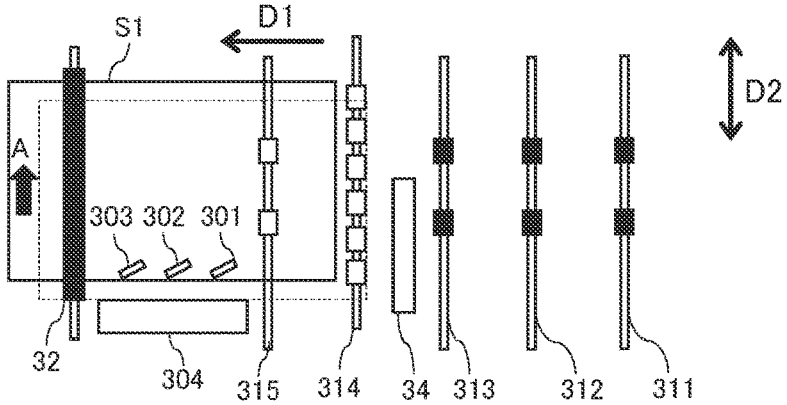
FIG. 5D is a top view illustrating an operation of the registration unit of the embodiment.
Figure 6D:
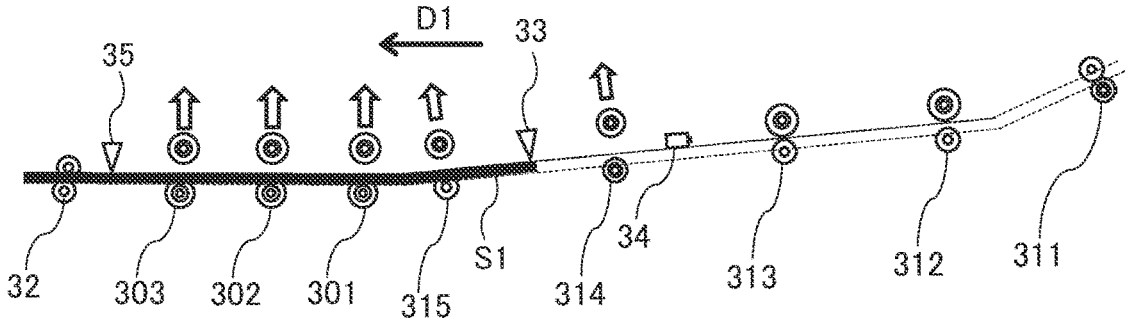
FIG. 6D is a side view illustrating an operation of the registration unit of the embodiment.

If the leading edge of the sheet S1 reaches the registration roller pair 32 (S9*a*), then the state of the oblique-feeding roller pairs 301 to 303 is switched to the separation state (FIG. 5D, FIG. 6D). After that, the registration roller pair 32 slides (as indicated by an arrow A in FIG. 5D) so that the sheet S1 is aligned with a reference position of an image formed by the image forming portion 90.

By repeating the above-described processes, the registration unit 30 conveys the sheet S1, which has been conveyed to the registration unit 30 one by one, while correcting the position and skew of the sheet S1.

Conveyance Operation for Sheets having Sheet Length less than Predetermined Length Next, a conveyance operation performed when the sheet length is smaller than a predetermined length will be described with reference to the flowchart of FIG. 10 and FIGS. 7A to 7D and 8A to 8D. Each of FIGS. 7A to 7D is a top view of the registration unit 30 that illustrates a conveyance operation for a sheet S2 whose sheet length Ls2 is smaller than a predetermined length. Each of FIGS. 8A to 8D is a side view of the registration unit 30 that illustrates a conveyance operation for the sheet S2 whose sheet length Ls2 is smaller than the predetermined length. Note that in FIGS. 7A to 7D, rollers of a roller pair in the contact state are illustrated in black, and rollers of a roller pair in the separation state are illustrated in outline alone.

If the sheet length is smaller than the predetermined length, then the state of the relay roller pair 315, disposed downstream of the pre-registration roller pair 314, is set to the contact state (S2*b*, FIG. 5A, FIG. 6A). After that, the sheet S2 is conveyed in a conveyance mode (S2*b* to S9*b*) where the relay roller pair 315 (i.e., the second roller pair) is in the contact state.

Figure 7A:
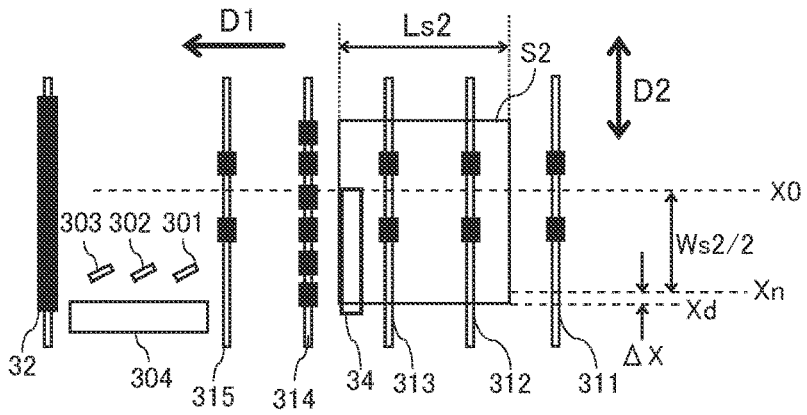
FIG. 7A is a top view illustrating an operation of the registration unit of the embodiment.
Figure 8A:
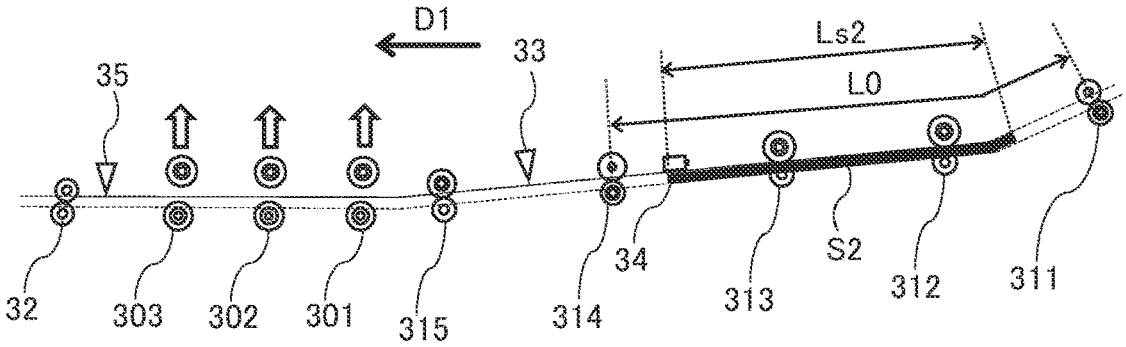
FIG. 8A is a side view illustrating an operation of the registration unit of the embodiment.

As illustrated in FIGS. 7A and 8A, the sheet S2 having been conveyed from the conveyance units disposed upstream of the registration unit 30 is conveyed by the conveyance roller pairs 311 to 313. When the leading edge of the sheet S2 reaches the CIS 34, a side-edge position Xd of the sheet S2 is detected by using the CIS 34 (S3*b*).

Then, the amount of deviation ΔX between the detected side-edge position Xd (FIG. 7A) of the sheet S2 and a target position Xn of the side edge of the sheet S2 is calculated. The target position Xn of the present embodiment is a side-edge position of the sheet S2 whose center line in the sheet width direction D2 is equal to the conveyance center line XO (that is, the target position Xn is a position separated from the conveyance center line XO by half a sheet width Ws2, or is a nominal side-edge position).

Figure 7B:
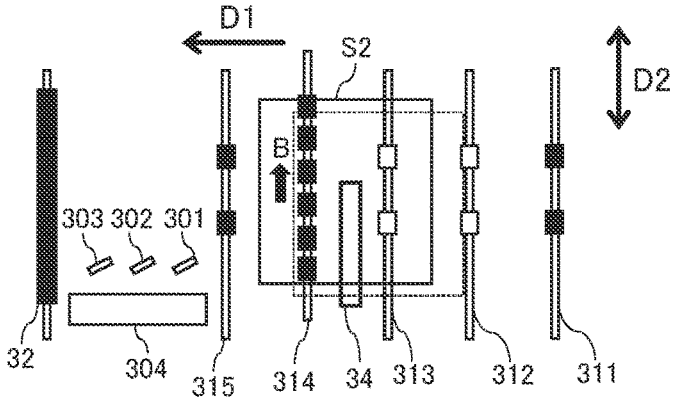
FIG. 7B is a top view illustrating an operation of the registration unit of the embodiment.
Figure 7C:
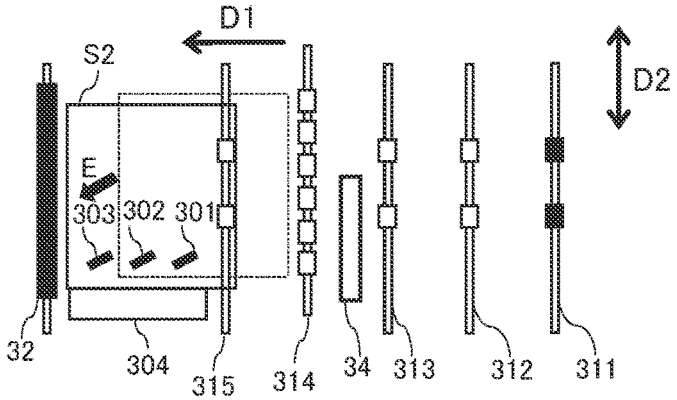
FIG. 7C is a top view illustrating an operation of the registration unit of the embodiment.
Figure 8B:
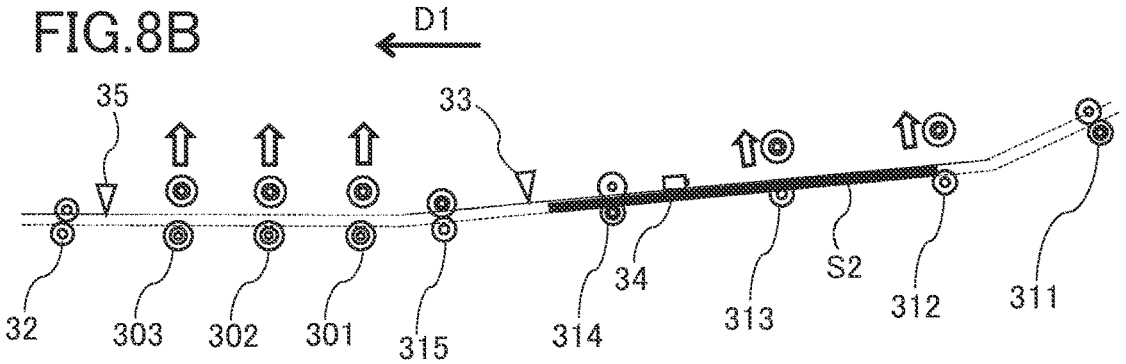
FIG. 8B is a side view illustrating an operation of the registration unit of the embodiment.

Then, the slide operation (shift operation, position correction operation) of the pre-registration roller pair 314 is performed for reducing the amount of deviation ΔX, as indicated by an arrow B in FIG. 7B (S4*b*). Specifically, after the leading edge of the sheet S2 enters the pre-registration roller pair 314, the state of the conveyance roller pairs 312 and 313, which are disposed upstream of the pre-registration roller pair 314, is switched to the separation state (FIG. 8B). Then, the controller 550 slides the pre-registration roller pair 314 so that the amount of deviation ΔX is reduced and the side edge of the sheet S2 approaches the target position Xn. With this operation, the sheet position is shifted so that the center line of the sheet S2 is aligned with the conveyance center line XO. The conveyance of the sheet S2 is continued even when the pre-registration roller pair 314 slides.

Note that a sheet length Ls2 of the sheet S2 is smaller than a path length L0 that extends from the conveyance roller pair 311, which is structurally in the contact state, to the pre-registration roller pair 314. Thus, when the leading edge of the sheet S2 enters the pre-registration roller pair 314, the sheet S2 is not being nipped by the conveyance roller pair 311. Thus, in a case where the sheet S2 having the smaller sheet length Ls2 is conveyed, the slide of the pre-registration roller pair 314 can be started immediately after the leading edge of the sheet S2 enters the pre-registration roller pair 314.

The relay roller pair 315 is in the contact state for the sheet S2 having the smaller sheet length Ls2. Thus, the slide of the pre-registration roller pair 314 is ended by the time the sheet S2 is nipped by the relay roller pair 315. In this case, since the slide of the pre-registration roller pair 314 is started immediately after the leading edge of the sheet S2 enters the pre-registration roller pair 314, it is possible to secure the period of time in which the pre-registration roller pair 314 can slide.

Thus, in the present embodiment, in a case where the second sheet (S2) whose sheet length is smaller than a predetermined length is conveyed, the movement of the first roller pair is started by the moving portion (i.e., the slide mechanism 36) after the leading edge of the second sheet reaches the first roller pair (i.e., the pre-registration roller pair 314). That is, in a case where the second sheet (S2) whose sheet length is smaller than a predetermined length is conveyed, the movement of the first roller pair is started by the moving portion (i.e., the slide mechanism 36), based on the leading edge of the second sheet having reached the first roller pair (i.e., the pre-registration roller pair 314). After that, the movement of the first roller pair by the moving portion is ended before the leading edge of the second sheet reaches the second roller pair (i.e., the relay roller pair 315). With this operation, the position correction of the second sheet can be completed during a period of time in which the sheet is not retained by any roller pair other than the first roller pair. As a result, the damage to the sheet can be avoided.

Note that if the amount of deviation ΔX detected by using the CIS 34 is large, and the slide of the pre-registration roller pair 314 cannot be completed by the time the leading edge of the sheet S2 reaches the relay roller pair 315, a user may be notified of the error and the conveyance operation may be stopped.

After the slide of the pre-registration roller pair 314 is ended, the sheet S2 enters the relay roller pair 315, and is delivered to the oblique feeding unit 300 via the relay roller pair 315 (S5*b*). If an interval between adjacent conveyance roller pairs is larger than the sheet length, the reliability of delivering the sheet may decrease. In the present embodiment, however, in a case where the sheet S2 having the shorter sheet length Ls2 is conveyed, the relay roller pair 315 is in the contact state. Thus, even when the sheet S2 having the shorter sheet length Ls2 is conveyed, the sheet S2 can be reliably conveyed from the pre-registration roller pair 314 to the oblique feeding unit 300 via the relay roller pair 315.

After the leading edge of the sheet S2 reaches the oblique-feeding roller pair 301, the state of the oblique-feeding roller pairs 301 to 303 is switched to the contact state (S6*b*). In this stage, the force by which the oblique-feeding roller pairs 301 to 303 nip the sheet S2 is weaker than the force by which the pre-registration roller pair 314 nips the sheet S2. Thus, the conveyance force given to the sheet S2 by the pre-registration roller pair 314 is dominant, so that the sheet S2 continues to move in the sheet conveyance direction D1. Note that the timing at which the state of the sheet S2 is switched to the contact state is determined, based on the timing at which the conveyance sensor 33 detects the leading edge of the sheet S2.

Figure 8C:
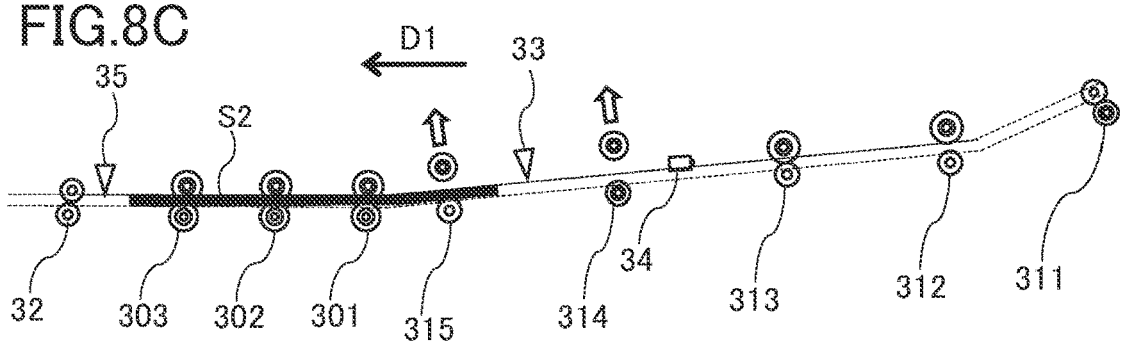
FIG. 8C is a side view illustrating an operation of the registration unit of the embodiment.

After that, the state of the pre-registration roller pair 314 is switched to the separation state (S7*b*, FIG. 8C). With this operation, the oblique conveyance force given to the sheet S2 by the oblique-feeding roller pairs 301, 302, and 303 becomes dominant, and the sheet S2 is conveyed while moving toward the side reference plate 304 in the sheet width direction (as indicated by an arrow E in FIG. 7C).

In the present embodiment, the rollers of the pre-registration roller pair 314 are separated from each other after the leading edge of the sheet S2 reaches the second oblique-feeding roller pair 302. That is, the rollers of the pre-registration roller pair 314 are separated from each other in a state where the sheet S2 is nipped by the most-upstream oblique-feeding roller pair 301 (i.e., the first oblique-feeding roller pair) and the second oblique-feeding roller pair 302 (i.e., the second oblique-feeding roller pair). With this operation, the sheet S2 can be delivered more reliably from the pre-registration roller pair 314 to the oblique feeding unit 300.

In particular, in the present embodiment, since the distance from the relay roller pair 315 to the most-upstream oblique-feeding roller pair 301 is shorter than the distance from the pre-registration roller pair 314 to the relay roller pair 315, the registration unit 30 can handle shorter sheets. Note that the state of the oblique-feeding roller pairs 301 to 303 may be switched to the contact state after the leading edge of the sheet S2 reaches the second oblique-feeding roller pair 302. In this case, a period of time in which the sheet S2 slips on the oblique feeding rollers 301*a* and 301*b* can be shortened.

After the side edge of the sheet S2 abuts against the abutment surface 304*a* of the side reference plate 304 (S8*b*), the oblique-feeding roller pairs 301 to 303 slip, and the sheet S2 pivots in accordance with the abutment surface 304*a*. In this manner, the skew of the sheet S2 is corrected. Even after the skew of the sheet S2 is corrected, the oblique-feeding roller pairs 301 to 303 convey the sheet S2 in the sheet conveyance direction D1, while causing the side edge of the sheet S2 to be in contact with the abutment surface 304*a*.

Figure 7D:
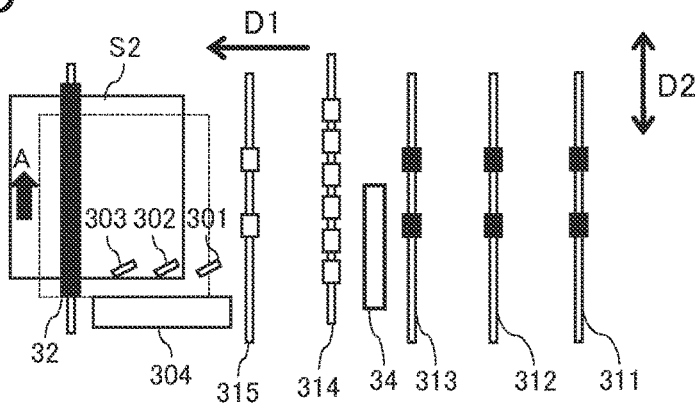
FIG. 7D is a top view illustrating an operation of the registration unit of the embodiment.
Figure 8D:
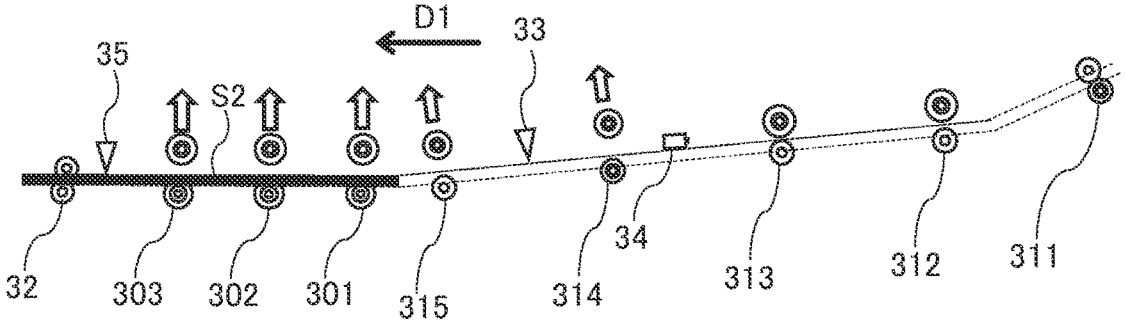
FIG. 8D is a side view illustrating an operation of the registration unit of the embodiment.

If the leading edge of the sheet S2 reaches the registration roller pair 32 (S9*b*), then the state of the oblique-feeding roller pairs 301 to 303 is switched to the separation state (FIG. 7D, FIG. 8D). After that, the registration roller pair 32 slides (as indicated by an arrow A in FIG. 7D) so that the sheet S2 is aligned with a reference position of an image formed by the image forming portion 90.

By repeating the above-described processes, the registration unit 30 conveys the sheet S2, which has been conveyed to the registration unit 30 one by one, while correcting the position and skew of the sheet S2.

Advantages of the Present Embodiment

As described above, in the present embodiment, the controller 550 changes the mode of the conveyance operation, depending on whether the sheet length is equal to or larger than a predetermined length.

If the sheet S1 having the larger sheet length Ls1 is conveyed, the controller 550 sets the state of the relay roller pair 315 to the separation state, and causes the slide mechanism 37 to slide the pre-registration roller pair 314, based on the detection result by the CIS 34; and after that, causes the pre-registration roller pair 314 to deliver the sheet S1 from the pre-registration roller pair 314 to the oblique feeding unit 300. In other words, if the first sheet having a first length in the sheet conveyance direction is conveyed, the control portion of the present embodiment causes the contact/separation portion to set the state of the second roller pair to the separation state, and causes the moving portion to move the first roller pair in the sheet width direction based on the detection result by the detection portion; and after that, causes the first sheet to be conveyed from the first roller pair to the oblique feeding portion. That is, if the first sheet whose length in the sheet conveyance direction is the first length is conveyed, the control portion of the present embodiment causes the moving portion to move the first roller pair in the sheet width direction based on the detection result by the detection portion; and after that, causes the first sheet to be conveyed from the first roller pair to the oblique feeding portion through the second roller pair that is in the separation state.

In this manner, in a case where the relatively long sheet S1 is conveyed, it is possible to secure the period of time in which the pre-registration roller pair 314 can slide, by separating the relay roller pair 315 from the sheet S1 in advance. In addition, since the sheet S1 is relatively long, the sheet S1 is smoothly delivered to the oblique feeding unit 300 even when the relay roller pair 315 is separated from the sheet S1.

If the sheet S2 having the smaller sheet length Ls2 is conveyed, the controller 550 sets the state of the relay roller pair 315 to the contact state, and causes the slide mechanism 37 to slide the pre-registration roller pair 314, based on the detection result by the CIS 34; and causes the pre-registration roller pair 314 to deliver the sheet S2 from the pre-registration roller pair 314 to the oblique feeding unit 300 via the relay roller pair 315. In other words, if the second sheet having a second length measured in the sheet conveyance direction and smaller than the first length is conveyed, the control portion of the present embodiment causes the contact/separation portion to set the state of the second roller pair to the contact state, and causes the moving portion to move the first roller pair in the sheet width direction based on the detection result by the detection portion; and after that, causes the second sheet to be conveyed from the first roller pair to the oblique feeding portion via the second roller pair. That is, if the second sheet whose length in the sheet conveyance direction is the second length smaller than the first length is conveyed, the control portion of the present embodiment causes the moving portion to move the first roller pair in the sheet width direction based on the detection result by the detection portion; and after that, causes the second sheet to be conveyed from the first roller pair to the oblique feeding portion via the second roller pair that is in the contact state.

In this manner, in a case where the sheet S2 having the shorter sheet length is conveyed, the sheet S2 can be more reliably conveyed to the oblique feeding unit 300 via the relay roller pair 315. If the sheet S2 is short, a period of time from when the sheet S2 is sent from the pre-registration roller pair 314 until when the leading edge of the sheet S2 reaches the relay roller pair 315 that is in the contact state is relatively sufficient. Thus, it is possible to secure a period of time in which the pre-registration roller pair 314 slides, even in a state where the relay roller pair 315 is in the contact state.

Thus, in the present embodiment, a variety of sizes of sheets can be used, and the variations in the conveyance timing can be reduced by sliding the pre-registration roller pair 314 before the oblique feeding is started by the oblique feeding unit 300.

Condition for Setting Predetermined Length

As described above, in the present embodiment, the conveyance mode is switched between a conveyance mode in which the relay roller pair 315 (i.e., the second roller pair) is in the contact state and a conveyance mode in which the relay roller pair 315 is in the separation state, depending on whether the sheet length is equal to or larger than a predetermined length. Hereinafter, a preferable set value of the predetermined length, which is a threshold value for switching the conveyance mode, will be described. Note that if the sheet length is equal to the predetermined length, which of the conveyance modes is selected may be changed.

Preferably, the predetermined length is equal to or smaller than the distance from the conveyance roller pair 311, which is structurally in the contact state, to the pre-registration roller pair 314 in the sheet conveyance direction D1 (that is, the predetermined length is preferably equal to or smaller than the distance from the upstream roller pair to the first roller pair in the sheet conveyance direction, or is equal to or smaller than the path length L0 in FIG. 6B). In this case, if the sheet is long, and the leading edge of the sheet will have already passed through the pre-registration roller pair 314 when the trailing edge of the sheet passes through the conveyance roller pair 311, the conveyance mode in which the relay roller pair 315 is in the separation state is always used. In this manner, it is possible to secure the period of time in which the pre-registration roller pair 314 slides on the long sheet.

In addition, the predetermined length is set longer than the distance from the pre-registration roller pair 314 to the most-upstream oblique-feeding roller pair 301 of the oblique feeding unit 300 in the sheet conveyance direction D1 (that is, the distance from the first roller pair to the oblique feeding portion in the sheet conveyance direction). With this setting, even in a state where the relay roller pair 315 is separated from the sheet, the sheet can be delivered from the pre-registration roller pair 314 to the oblique feeding unit 300.

In addition, it is preferable that the predetermined length be set longer than the distance from the pre-registration roller pair 314 to the second oblique-feeding roller pair 302 of the oblique feeding unit 300 in the sheet conveyance direction D1 (that is, the distance from the first roller pair to the second oblique-feeding roller pair in the sheet conveyance direction). Since the oblique-feeding roller pairs 301 to 303 convey the sheet while slipping on the sheet, the force by which the oblique-feeding roller pairs 301 to 303 nip the sheet is commonly weaker than the force by which other conveyance roller pairs nip the sheet. In the present embodiment, however, since the predetermined length is set longer than the above-described distance, the sheet can be delivered more reliably from the pre-registration roller pair 314 to the oblique feeding unit 300. That is, in the conveyance mode in which the relay roller pair 315 is in the separation state, at least two oblique-feeding roller pairs 301 and 302 nip the sheet before the trailing edge of the sheet passes through the pre-registration roller pair 314. As a result, the possibility that the failure in conveyance occurs is reduced.

In an example of configuration of the present embodiment, the predetermined length is set at 295.7 mm. Thus, if a sheet having a sheet length of a long side of the A4-sheet, a sheet length of a short side of the A3-sheet, or a sheet length larger than the sheet length of the long side of the A4-sheet and the sheet length of the short side of the A3-sheet is fed, the conveyance mode in which the relay roller pair 315 is in the separation state is used. The value of the predetermined length may be changed as appropriate in accordance with a specific configuration of the image forming apparatus.

Other Examples

In the above-described embodiment, the CIS 34 is used, as an example, as a detection portion that detects the sheet position in the sheet width direction D2. Instead of the CIS 34, a charge-coupled device (CCD) image sensor (line sensor) may be used. In another case, a photoelectric sensor that detects the sheet at a predetermined position (target position) in the sheet width direction D2 may be used as the detection portion. In this case, after the movement of the pre-registration roller pair 314 is started, the movement of the pre-registration roller pair 314 may be ended when the photoelectric sensor detects the side edge of the sheet. In addition, the detection portion may not be disposed upstream of the pre-registration roller pair 314, and may be disposed downstream of the pre-registration roller pair 314.

In addition, in the above-described embodiment, the target position Xn, into which the pre-registration roller pair 314 corrects the sheet position in the sheet width direction D2, is a side-edge position of the sheet whose center line is located on the conveyance center line. However, the target position may not be defined with respect to the conveyance center line. If the target position is set at a position separated from the side reference plate 304 by a predetermined distance, the variations in the conveyance timing can be reduced.

In the above-described embodiment, the description has been made, as an example, for the printer 1 that is an intermediate-transfer electrophotographic apparatus, which serves as an image forming apparatus. The present disclosure, however, can be applied to another image forming apparatus other than the printer 1. Examples of the image forming apparatus include a printing machine (i.e., a production printer) for commercial printing, a single-function printer used in office or home, a copying machine, and a multi-function printer. In addition, the image forming portion may not be the intermediate-transfer electrophotographic unit. For example, the image forming portion may be a direct-transfer electrophotographic unit, an inkjet image forming unit, or an offset-printing mechanism.

In addition, the sheet conveyance apparatus may not be the apparatus that conveys sheets toward the image forming portion. For example, the sheet conveyance apparatus may be an apparatus that conveys sheets in a sheet processing apparatus. The sheet processing apparatus is an apparatus (referred to also as a finisher) connected to the image forming apparatus body and used for performing processes, such as a bookbinding process and a sort process, on sheets on which images are formed. In addition, the sheet conveyance apparatus may be an apparatus that is used independently from the image forming apparatus (for example, the apparatus may be a sorting apparatus that sorts sheet-like articles, such as mails, or may be an inspection apparatus that inspects sheet-like products while conveying the products).

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-107601, filed on Jul. 4, 2022, which is hereby incorporated by reference herein in its entirety.

What is claimed is:

1. A sheet conveyance apparatus comprising:

a first roller pair configured to convey a sheet;

a second roller pair disposed downstream of the first roller pair in a sheet conveyance direction and configured to convey the sheet;

an abutment portion against which an edge portion of the sheet in a sheet width direction orthogonal to the sheet conveyance direction is abutted;

an oblique feeder disposed downstream of the second roller pair in the sheet conveyance direction and configured to move the sheet toward the abutment portion in the sheet width direction while moving the sheet downstream in the sheet conveyance direction and convey the sheet while causing the edge portion of the sheet to abut against the abutment portion;

a detector configured to detect a position of the sheet in the sheet width direction;

a first driver configured to move the first roller pair in the sheet width direction;

a second driver configured to switch a state of the second roller pair between a contact state and a separation state, the contact state being a state where rollers of the second roller pair are in contact with each other, the separation state being a state where the rollers are separated from each other; and a control portion configured to control the first driver and the second driver, wherein the control portion is configured such that in a case where a first sheet whose length in the sheet conveyance direction is a first length is conveyed, the control portion causes the first driver to move the first roller pair in the sheet width direction based on a detection result by the detector, and then causes the first sheet to be conveyed from the first roller pair to the oblique feeder through the second roller pair that is in the separation state, and in a case where a second sheet whose length in the sheet conveyance direction is a second length shorter than the first length is conveyed, the control portion causes the first driver to move the first roller pair in the sheet width direction based on a detection result by the detector, and then causes the second sheet to be conveyed from the first roller pair to the oblique feeder via the second roller pair that is in the contact state.

2. The sheet conveyance apparatus according to claim 1, further comprising:

an upstream roller pair which is disposed upstream of the first roller pair in the sheet conveyance direction and in which rollers are structurally in contact with each other, wherein the control portion is configured such that in a case where the first sheet is conveyed, the control portion causes the first driver to start movement of the first roller pair based on (i) a leading edge of the first sheet having reached the first roller pair and (ii) a trailing edge of the first sheet having passed through the upstream roller pair, and in a case where the second sheet is conveyed, the control portion causes the first driver to start the movement of the first roller pair based on a leading edge of the second sheet having reached the first roller pair.

3. The sheet conveyance apparatus according to claim 2, wherein the control portion is configured such that in a case where the first sheet is conveyed, the control portion causes the first driver to end the movement of the first roller pair before the leading edge of the first sheet reaches the oblique feeder, and in a case where the second sheet is conveyed, the control portion causes the first driver to end the movement of the first roller pair before the leading edge of the second sheet reaches the second roller pair.

4. The sheet conveyance apparatus according to claim 2, wherein the control portion is configured such that in a case where a sheet whose length in the sheet conveyance direction is equal to or larger than a predetermined length is conveyed, the control portion causes the second driver to set the second roller pair to the separation state, and in a case where a sheet whose length in the sheet conveyance direction is smaller than the predetermined length is conveyed, the control portion causes the second driver to set the second roller pair to the contact state, and wherein the predetermined length is larger than a distance from the first roller pair to the oblique feeder in the sheet conveyance direction, and is equal to or smaller than a distance from the upstream roller pair to the first roller pair in the sheet conveyance direction.

5. The sheet conveyance apparatus according to claim 2, further comprising:

at least one roller pair which is disposed between the upstream roller pair and the first roller pair in the sheet conveyance direction, and in each of which, rollers are configured to be brought into contact with and separated from each other, wherein the control portion is configured to separate the rollers of each of the at least one roller pair from each other before causing the first driver to start the movement of the first roller pair.

6. The sheet conveyance apparatus according to claim 1, wherein the oblique feeder includes a first oblique-feeding roller pair, and a second oblique-feeding roller pair disposed downstream of the first oblique-feeding roller pair in the sheet conveyance direction, and wherein a distance from the second roller pair to the first oblique-feeding roller pair in the sheet conveyance direction is shorter than a distance from the first roller pair to the second roller pair in the sheet conveyance direction.

7. The sheet conveyance apparatus according to claim 6, wherein the control portion is configured such that in a case where the first sheet is conveyed, the control portion causes the first oblique-feeding roller pair and the second oblique-feeding roller pair to start oblique feeding of the first sheet, by separating rollers of the first roller pair from each other after a leading edge of the first sheet reaches the second oblique-feeding roller pair, and in a case where the second sheet is conveyed, the control portion causes the first oblique-feeding roller pair and the second oblique-feeding roller pair to start oblique feeding of the second sheet, by separating the rollers of the first roller pair from each other and separating the rollers of the second roller pair from each other after a leading edge of the second sheet reaches the second oblique-feeding roller pair.

8. The sheet conveyance apparatus according to claim 6, further comprising:

an upstream roller pair which is disposed upstream of the first roller pair in the sheet conveyance direction and in which rollers are structurally in contact with each other, wherein the control portion is configured such that in a case where a sheet whose length in the sheet conveyance direction is equal to or larger than a predetermined length is conveyed, the control portion causes the second driver to set the second roller pair to the separation state, and in a case where a sheet whose length of the sheet in the sheet conveyance direction is smaller than the predetermined length is conveyed, the control portion causes the second driver to set the second roller pair to the contact state, and wherein the predetermined length is larger than a distance from the first roller pair to the second oblique-feeding roller pair in the sheet conveyance direction, and is equal to or smaller than a distance from the upstream roller pair to the first roller pair in the sheet conveyance direction.

9. The sheet conveyance apparatus according to claim 1, wherein the control portion is configured to cause the first driver to move the first roller pair in the sheet width direction based on a detection result by the detector, such that the sheet is moved in such a manner that a side edge of the sheet approaches a target position separated from the abutment portion in the sheet width direction by a predetermined distance.

10. The sheet conveyance apparatus according to claim 9, wherein the target position is a side-edge position of the sheet whose center line in the sheet width direction is equal to a conveyance center line of a conveyance path in which the sheet is conveyed to the first roller pair.

11. The sheet conveyance apparatus according to claim 1, wherein the detector is disposed upstream of the first roller pair in the sheet conveyance direction.

12. The sheet conveyance apparatus according to claim 1, wherein the detector is a line sensor disposed along the sheet width direction and including a plurality of light receiving elements.

13. An image forming apparatus comprising:

the sheet conveyance apparatus according to claim 1; and an image forming portion configured to form an image on a sheet conveyed by the sheet conveyance apparatus.

14. A sheet conveyance apparatus comprising:

a first roller pair configured to convey a sheet;

a second roller pair disposed downstream of the first roller pair in a sheet conveyance direction and configured to convey the sheet;

an abutment portion against which an edge portion of the sheet in a sheet width direction orthogonal to the sheet conveyance direction is abutted;

an oblique feeder disposed downstream of the second roller pair in the sheet conveyance direction and configured to move the sheet toward the abutment portion in the sheet width direction while moving the sheet downstream in the sheet conveyance direction and convey the sheet while causing the edge portion of the sheet to abut against the abutment portion;

a detector configured to detect a position of the sheet in the sheet width direction;

a first driver configured to move the first roller pair in the sheet width direction;

a second driver configured to switch a state of the second roller pair between a contact state and a separation state, the contact state being a state where rollers of the second roller pair are in contact with each other, the separation state being a state where the rollers are separated from each other; and a control portion configured to control the first driver and the second driver, wherein the control portion is configured such that in a case where a first sheet whose length in the sheet conveyance direction is a first length is conveyed, the control portion causes the first driver to move the first roller pair in the sheet width direction based on a detection result by the detector in a state in which the second roller pair is in the separation state, and then causes the first sheet conveyed by the first roller pair to reach the oblique feeder in a state in which the second roller pair is in the separation state, and in a case where a second sheet whose length in the sheet conveyance direction is a second length shorter than the first length is conveyed, the control portion causes the first driver to move the first roller pair in the sheet width direction based on a detection result by the detector in a state in which the second roller pair is in the contact state, and then causes the second sheet conveyed by the second roller pair to reach the oblique feeder.

15. The sheet conveyance apparatus according to claim 14, further comprising:

an upstream roller pair which is disposed upstream of the first roller pair in the sheet conveyance direction and in which rollers are structurally in contact with each other, wherein the control portion is configured such that in a case where the first sheet is conveyed, the control portion causes the first driver to start movement of the first roller pair based on (i) a leading edge of the first sheet having reached the first roller pair and (ii) a trailing edge of the first sheet having passed through the upstream roller pair, and in a case where the second sheet is conveyed, the control portion causes the first driver to start the movement of the first roller pair based on a leading edge of the second sheet having reached the first roller pair.

16. The sheet conveyance apparatus according to claim 15, wherein the control portion is configured such that in a case where the first sheet is conveyed, the control portion causes the first driver to end the movement of the first roller pair before the leading edge of the first sheet reaches the oblique feeder, and in a case where the second sheet is conveyed, the control portion causes the first driver to end the movement of the first roller pair before the leading edge of the second sheet reaches the second roller pair.

17. The sheet conveyance apparatus according to claim 15, wherein the control portion is configured such that in a case where a sheet whose length in the sheet conveyance direction is equal to or larger than a predetermined length is conveyed, the control portion causes the second driver to set the second roller pair to the separation state, and in a case where a sheet whose length in the sheet conveyance direction is smaller than the predetermined length is conveyed, the control portion causes the second driver to set the second roller pair to the contact state, and wherein the predetermined length is larger than a distance from the first roller pair to the oblique feeder in the sheet conveyance direction, and is equal to or smaller than a distance from the upstream roller pair to the first roller pair in the sheet conveyance direction.

18. The sheet conveyance apparatus according to claim 14, wherein the control portion is configured to cause the first driver to move the first roller pair in the sheet width direction based on a detection result by the detector, such that the sheet is moved in such a manner that a side edge of the sheet approaches a target position separated from the abutment portion in the sheet width direction by a predetermined distance.

19. The sheet conveyance apparatus according to claim 18, wherein the target position is a side-edge position of the sheet whose center line in the sheet width direction is equal to a conveyance center line of a conveyance path in which the sheet is conveyed to the first roller pair.

20. The sheet conveyance apparatus according to claim 14, wherein the detector is a line sensor disposed along the sheet width direction and including a plurality of light receiving elements.

* * * * *